US006866527B2

(12) United States Patent
Potega

(10) Patent No.: US 6,866,527 B2
(45) Date of Patent: Mar. 15, 2005

(54) CONNECTOR ASSEMBLY FOR ELECTRICAL SIGNAL TRANSFER AMONG MULTIPLE DEVICES

(76) Inventor: Patrick Potega, 7021 Vicky Ave., West Hills, CA (US) 91307-2314

( * ) Notice: Subject to any disclaimer, the term of this patent is extended or adjusted under 35 U.S.C. 154(b) by 0 days.

(21) Appl. No.: 10/403,253

(22) Filed: Mar. 31, 2003

(65) Prior Publication Data

US 2003/0207603 A1 Nov. 6, 2003

Related U.S. Application Data

(60) Division of application No. 09/378,781, filed on Aug. 23, 1999, now Pat. No. 6,634,896, which is a continuation-in-part of application No. PCT/US99/19181, filed on Aug. 23, 1999.

(51) Int. Cl.[7] ..... H01R 27/00
(52) U.S. Cl. ..... 439/218; 439/668
(58) Field of Search ..... 439/218, 221–224, 439/668–669

(56) References Cited

U.S. PATENT DOCUMENTS 4,420,216 A * 12/1983 Motoyama et al. ..... 439/188
5,137,469 A * 8/1992 Carpenter et al. ..... 439/578
5,569,053 A * 10/1996 Nelson et al. ..... 439/668
5,823,796 A * 10/1998 Bethurum ..... 439/76.1
5,915,995 A * 6/1999 Meyer et al. ..... 439/668
6,044,472 A * 3/2000 Crohas ..... 713/300
6,109,797 A * 8/2000 Nagura et al. ..... 385/88
6,149,469 A * 11/2000 Kim ..... 439/668
6,459,175 B1 * 10/2002 Potega ..... 307/149

* cited by examiner

*Primary Examiner*—Hae Moon Hyeon

(57) ABSTRACT

A connector assembly for power and/or data connections, comprised of a connector apparatus (210 in FIGS. 2A and B) which has a configurable plug (102A) with conductors (123A and B, and 125A and B), and a multi-segmented pin-style assembly (127) that engages a receptacle (189) having conductors (193, 195, 197, and 199), and related elements (178) that redirect electrical signals upon insertion of the plug. Redirecting electrical signals enables host devices, power sources, and peripherals—such as a host device (168), its battery source (187), as well as one or more attachable peripherals (150, 152, 154, 156, 158, 160, 162 and 164 in FIG. 1)—to transfer signals in ways they could not without such an apparatus. By locating a receptacle (189) in replaceable modules, such as battery packs (187), users can upgrade and enhance the functionality of a multiplicity of existing (and future) electronic and electrical goods.

3 Claims, 3 Drawing Sheets

125A
125B
N-Signal Switch
123A
178
123B
102A
181A
181B
179A
181C
179B
181D
127
179C
183

187
182A
182B
182C
189
180A
180B
182D
211B
210
190
180C
195
193
D
213
183A
191
195A
197
199
211A
197A
209
D
193A
207
Host Device
168
A/D Converter
174
Processor
172
Program Instructions
170
201
199A
203

3/3

CONNECTOR ASSEMBLY FOR ELECTRICAL SIGNAL TRANSFER AMONG MULTIPLE DEVICES

CROSS-REFERENCE TO RELATED APPLICATIONS

This application is a division of "Method and Apparatus for Transferring Electrical Signals Among Electrical Devices," now U.S. Pat. No. 6,634,896, issued 21 Oct. 2003, previously filed as U.S. patent application Ser. No. 09/378,781, dated 23 Aug. 1999 as a CIP of (also previously filed as International Patent Application No. PCT/US99/19181, dated 23 Aug. 1999, claiming the benefit of) "Apparatus for Monitoring Temperature of a Power Source," filed previously as U.S. patent application Ser. No. 09/105,489, dated 26 Jun. 1998, and subsequently as U.S. Pat. No. 6,152,597 issued 28 Nov. 2000; and claims the benefit of previously filed U.S. Provisional Patent Application No. 60/051,035, dated 27 Jun. 1997, and "A Resistive Ink-Based Thermistor," U.S. Provisional Patent Application No. 60/055,883, dated 15 Aug. 1997, as well as International Patent Application No. PCT/US98/12807, dated 26 Jun. 1998; and further claims the benefit of "Apparatus for a Power and/or Data I/O," U.S. Provisional Patent Application No. 60/097,748, filed 24 Aug. 1998; "Hardware to Configure Battery and Power Delivery Software," U.S. Provisional Patent Application No. 60/114,412, dated 31 Dec. 1998, and subsequently U.S. patent application Ser. No. 09/475,946, "Hardware for Configuring and Delivering Power," dated 31 Dec. 1999; "Software to Configure Battery and Power Delivery Hardware," U.S. Provisional Patent Application No. 60/114,398, dated 31 Dec. 1998, and subsequently U.S. patent application Ser. No. 09/475,945, "Software for Configuring and Delivering Power," dated 31 Dec. 1999; and "Universal Power Supply," now U.S. Pat. No. 6,459,175, issued 1 Oct. 2002, previously filed as U.S. patent application Ser. No. 09/193,790, dated 17 Nov. 1998 (also as International Patent Application No. PCT/US98/24403, dated 17 Nov. 1998), filed previously as U.S.

Provisional Patent Application No. 60/065,773, dated 17 Nov. 1997.

FIELD OF INVENTION

The invention relates to connector-interface apparatuses, specifically to a connector assembly that is configurable to selectively inter-connect power sources, powered devices, and a multiplicity of attachable peripherals.

BACKGROUND OF THE INVENTION

Devices that have removable battery packs, such as laptop computers, personal audio and video players, etc., most often have two power input jacks. The first power-input port is obvious . . . it is where the connector from the external wall adapter, AC/DC power-conversion adapter, DC/DC automotive cigarette-lighter adapter, external battery charger, etc., is plugged in.

The second power-input port is not so obvious . . . it is where a removable battery pack connects to its associated host device. Usually, this is a power (or mixed-signal power and data) connector hidden in a battery bay, or expressed as a cord and connector inside a battery compartment, such as is found in some cordless phones. The connector between a battery pack and its associated host device may simply be a group of spring contacts and a mating set of contact pads. This second power port is not used for external power (a host's removable battery power source is usually not classified as "external" power). The battery power port is so unrecognized that even supplemental external "extended run-time" battery packs, as are available from companies like Portable Energy Products, Inc. (Scotts Valley, Calif.), connect to the same traditional power jack to which the external power supply does.

The connector assembly herein exploits this unutilized battery-to-host interface in a number of ways. As will be seen, a battery pack's power port is, in many ways, a far more logical power interface than the traditional power-input jack. By using a flexible and scaleable connector that is small enough to be enclosed within a battery pack housing, and providing sufficient connector contacts to handle power, the usefulness of external power devices and the battery pack itself can be enhanced.

Also, "smart" battery packs support connectors that are mixed signal, i.e., both power and data, therefore external power devices can data communicate with host devices and "smart" batteries, often facilitating device configuration, operation, and power monitoring.

Some of the reasons why the battery-contact interface isn't used are that it's often inaccessible. In laptop computers, for example, the battery-to-host-device connector is often buried deep in a battery bay. The connector assembly described in this document is built into the battery pack itself, at a location where easy access to a connector is available. Where appropriate, conductors from a non-removable battery are routed to an accessible location on the host device. Even when the location of the connector assembly is remote from the battery pack, the interface addressed is that between the battery pack and its associated connector on the host device.

Another reason for the lack of attention to the battery's power connector is that the type of connector used between a battery and its host device is not usually of the design and style that would easily lend itself to being attached to the end of a power cord. A good example of how awkward such battery access connectors can be is the "empty" battery housing with power cord that is popular with camcorders. The camcorder's "faux" battery pack shell snaps into the normal battery pack mount, and there is usually a hardwired cord to a power-conversion adapter. This makes for a considerable amount of bulky goods to transport. That is the case with cellular phones, as well, with "empty" battery housings that plug into an automotive cigarette lighter, or a battery pack with an integrated charger.

These are often bulkier than the battery pack they replace and, almost always, one must have a unique assembly—complete with cords—dedicated to a specific make or model of cellular phone.

The connector assemblies shown in the various figures, and described herein, are designed to be of the look and style normally associated with power and or data cords. Segmented-pin-type connectors are a common style. By defining new pin-style connectors that feature segmented receptacle contacts, or using segmented pin connectors in wiring schemes that create new connectivity paths, hitherto unknown ways of dealing with safety through power subsystem configurations are achieved. No bulky external add-ons are used. Instead, miniaturized connectors that can be embedded within an existing battery pack define new ways of powering battery-powered devices.

The battery packs discussed here are not empty battery enclosures, with only passthrough wiring. The original battery cells, circuit boards, fuses, etc., are all present and the connectors shown herein provide means to have a battery pack operate normally when a plug is removed (or replaced).

Battery Pack Removal

Another reason a battery port connector is not used is that to access this unexploited power port would require removing the battery pack, which would result in the loss of available battery power. Some host devices require that a battery pack be present, as the battery may be serial-wired. Also, host devices are known that use the battery pack as a "bridge" battery that keeps CMOS, clocks, etc., functioning. Battery removal could negatively impact such devices. Removing a battery pack also results in even more bulky things to carry around, which hardly fits the travel needs of someone carrying a laptop or other mobile device.

By embedding connectors in the battery pack, no circuits are created within the host devices. This is useful because battery packs are virtually always removable and replaceable. Instead of having to pre-plan and design-in new power and/or data paths into a host device, the replaceable battery pack contains these new electrical paths. Simply replacing a removable battery pack upgrades any host device. By placing the technology in a fully-functional battery pack, it is not necessary to remove the battery pack during connector assembly operations . . . instead, keeping the battery pack in its host device, where it belongs, is essential.

Devices that use external power-conversion adapters invariably are designed to always charge the device's battery pack every time the external adapter is attached. It seems logical that keeping battery capacity at 100% is a sound practice. However, certain rechargeable battery chemistries don't offer the charge/recharge cycle life that was available with "older" battery technologies. Lithium-Ion (Li-Ion) batteries, for example, can last for only 300 cycles, and sometimes even less than that. In average use, an Li-Ion battery can have a useful life (full run-time, as a function of capacity) of less than a year, and nine months isn't uncommon. Constantly "topping-off" a Li-Ion battery only degrades useful battery life.

Being able to elect when to charge the battery, independent of powering the host device, will prolong the life of expensive batteries. By delivering power from external power adapters and chargers through connectors at a newly-defined battery power I/O port, a user need only perform a simple act, such as inserting a plug specific to a battery-charging mode, or a host-power-only mode, or both.

Battery Charging Risks

Battery charging is a destructive process in other ways than repeated unnecessary battery charging sessions. Low-impedance batteries, such as Li-Ion, generate heat during the charging process. This is especially true if a cell-voltage imbalance occurs because, as cell resistance increases while charging, the entire battery pack has been known to overheat. Li-Ion cells have a reputation for volatility. For example, an article in the Apr. 2, 1998, edition of *The Wall Street Journal* reported on the potentials of fire, smoke and possible explosion of Li-Ion batteries on commercial aircraft (Andy Pasztor, "Is Recharging Laptop in Flight a Safety Risk?", *The Wall Street Journal*, Apr. 2, 1998, pp. B1, B12).

To be able to easily disengage a volatile battery cell cluster from its integrated, hardwired battery charging circuit has obvious safety benefits. The connector assemblies discussed herein lend themselves to a simple battery bypass circuit within the battery pack, so that a host device can be powered from an external power source such as an aircraft seat-power system, without charging the battery. This function is achievable by simply replacing an existing battery pack with one that incorporates the subject connector assembly. This is a cost-effective, simple and convenient solution to an important safety concern.

The heat dissipation from charging a Li-Ion battery pack is compounded by the heat being generated by advanced high-speed CPUs. With computer processors running so hot in portable devices that heat sinks, fans, heat pipes, etc., are required, the additional heat from charging a battery only intensifies the thermal issues.

The connector assembly described herein, by disengaging battery charging, extends the life of a host device's components and circuits that otherwise may be compromised or stressed by extended hours of exposure to heat. This is especially valid for host devices such as laptop computers, since a number of these products are not used for travel, but instead spend almost all of their useful lives serving as a desktop substitute, permanently plugged into the AC/DC wall adapter in a home or office. In such device applications, the need to repeatedly charge the laptop's battery has no practicality. By using a connector assembly that can be selectively put into a mode for battery charging only when necessary, the working life expectancy of these host devices can be extended by eliminating unnecessary overheating.

Because the connector assembly is a modification to an existing battery pack, and battery products already have a well-established and wide distribution network, availability of this safety device is widespread. No entirely new devices are required to be designed and fabricated, since the connector assembly is essentially an upgrade modification.

Power-Conversion Adapters

Battery flammability and explosive volatility are related to inappropriate power devices in circuits upstream of the battery pack. Connecting an AC/DC power-conversion adapter that has an output voltage not matched to the input voltage of a host device is an easy mistake to make. Laptop computer input voltages, for example, can range from 7.2 VDC, to 24 VDC. Within that voltage range are a significant number of AC/DC and DC/DC power-conversion adapters that are connector-fit compatible, but which output incompatible voltages. A count of notebook computer power-conversion adapters available from one mail order company numbered over 250 discrete products (iGo, Reno, Nev., www.iGoCorp.com). The probability of a voltage mismatch indicates a serious safety concern.

As will be addressed in more detail later, to further exacerbate this plethora of power supplies problem, there are some 42 different types of existing laptop power connectors attached randomly to these 200+ power adapters. The connector assembly described herein also solves this connector mismatch issue.

Compared to the multiplicity of vast and diverse input voltages battery-powered host devices require when connecting to the device's power input jack, input voltages at battery power I/O ports are not only limited, but more input-voltage tolerant. Since battery output voltages are a function of an individual cell voltage, multiplied by the number of cells wired in series or parallel, there are a limited number of output voltages for battery packs. For example, Li-Ion cylindrical cells are manufactured at only 3.6-volts (some are 4.2-volt cells). Thus, virtually every Li-Ion battery pack made outputs either 10.8-volts, or 14.4-volts (with some relatively rare 12.6-volt cell clusters). If an external power-conversion adapter was designed to provide power to a notebook computer host device through the host device's battery power I/O port (instead of at the power input jack), it is possible that only two output voltages would be required, since the external adapter would electrically "behave" as a battery pack to a host device.

Furthermore, battery output voltages vary as a function of charge state. A fully charged battery—rated at 10.8-volts—actually outputs voltages in a range from about 10-volts, through 14.0-volts (with transient voltages up to 16 volts), depending on the battery's state of charge or discharge. So, by delivering power to a host device at its battery-to-host I/O port, a wide range of acceptable voltages is available. This same host device usually only will accept input voltages at its power-adapter input jack within a narrow voltage tolerance range of +/−1-volt. Thus, delivering power to a host device at its battery I/O port provides a far greater safety tolerance for potential voltage mismatches, as compared to power delivery at the traditional power jack. Also, providing a power connector that uses the battery's power I/O port, significantly reduces the number of external power devices, and the overall risk of damaging a host device by a voltage mismatch is minimized almost to insignificance.

Energy Conservation

There's a less obvious reason than safety to not charge batteries on commercial aircraft. Some commercial aircraft provide power outlets at the passenger seat. The headend of this "seat-power" system is a generator, so the total amount of energy to power all of the power outlets is limited. The Airbus A319, for example, has only sufficient generator capacity to provide "seat-power" for less than 40 passengers' laptop computers (Airbus Service Information Letter (SIL), dated 8 Jan. 1999). A laptop computer being powered from a power-conversion adapter connected at its power I/O jack uses 20–40% of the power to charge its battery pack, which translates to about 15–30 Watts per device. Generating sufficient power to charge 200+ laptop batteries puts a considerable drain on the aircraft's generator-driven electrical system.

Disabling battery charging by employing a connector assembly described herein is a cost-effective means of lowering an airline's operating costs, by minimizing the total load schedule of the cabin power grid. The airline saves the cost of the fuel required to operate the generator at a higher power capacity.

Another related issue is that airline operators have policies and in-flight rules that prohibit the types of passenger electronic devices that can legally operate on the plane. The use of RF devices, such as cellular phones, and radio-controlled toys, is banned on most every commercial aircraft. Passengers may be confused on aircraft operated by American Airlines, for example, since selected passenger seats have power systems for laptop use. This airline's seat power outlet is a standard automotive cigarette-lighter receptacle, just like the one in an automobile. An unsuspecting passenger, mistakenly assuming that the cigarette-lighter receptacle is for cellular phones, could easily plug in and turn on a cell phone.

Because there are a number of modalities to the connector assembly described in this document, airlines can elect to use a specific dedicated receptacle configuration, or wiring scheme that is reserved for passenger seat-power. By limiting the use of such a receptacle at passenger seats to laptops, and not allowing the seat receptacle to be used for cellular phones, an airline operator controls the types of passenger devices it allows to be connected to its cabin power system.

Battery-Only-Powered Devices

There is also a variety of battery-powered devices that does not have a power input jack. Cordless power tools, flashlights, and other devices meant to run strictly on removable, and/or externally rechargeable, batteries are typically not manufactured to accept an alternative source of power. If the battery of a cordless drill goes dead, the only recourse is to remove the battery and recharge it in its external charger. This is frustrating to a user who has to stop in the middle of a project to wait for a battery to recharge.

By integrating a new connector assembly, such as the ones shown in the figures and text herein, circuits can be created that use a host device's battery-power-port interface as a power connection through which an external power source delivers power. A user can elect, when a power outlet is available, to operate devices such as battery-powered drills, saws, flashlights, etc., from external power, simply by attaching a power adapter into a receptacle exposed on an accessible face of the device's battery pack. With some modalities of the connector assembly of the present invention, an external charger can be connected along with a power supply as well, allowing simultaneous equipment use and battery charging in electrical products that hitherto did not have these capabilities.

Devices with holders for individual replaceable primary battery cells fall into this same category of not having an external power I/O port. If the device does have an external port, it is usually not wired to provide simultaneous battery charging but only delivers power to the device. Not being able to charge replaceable battery cells in a battery holder while the batteries are in the host device lessens the usefulness of rechargeable alkaline cells, for example.

Charging peripherals for individually replaceable battery cells requires removing the cells from the device's battery holder. It is more convenient to leave these cells in their battery holder while charging, and the connector assembly discussed herein provides that convenience. The added convenience of being able to operate a host device instead of draining its rechargeable alkalines (these battery types typically can only be recharged 10–20 times, then must be discarded), reduces device operating costs. The use of the connector assembly herein also saves time, since the user doesn't have to take the time to turn off the device, remove each individual cell, place it in a special charger, then replace all the cells back in the holder.

Operational Advantages

Given the above, a number of operational advantages of the connector assembly of the subject invention become apparent:

(a). A simple, low-cost connector can be used to electrically isolate two previously coupled devices, such as a host device and its battery.

(b). By isolating the battery source, or a peripheral, from the host device, new circuits are created that enable a multiplicity of peripherals (e.g., external power sources, battery chargers, monitoring devices, external batteries, etc.) to be used. These add-on peripherals also operate more safely, because the battery voltage can be verified before the external peripheral is turned on.

(c). Because a plug is configurable to create additional circuits that were previously unavailable, specialty functions or operations will now be performed at the battery and/or host device.

(d). A variety of uniquely configured plugs can be interchanged, thus affording selective access to electronic and electrical devices.

(e). With its very small form factor, a receptacle is embedded inside a battery pack, to make it a self-contained device that has a special power (and/or data) interface to external power, charging, or monitoring peripherals. This can be accomplished without having to rewire or otherwise modify a host device. By replacing the existing battery pack with one configured with a connector assembly herein, the functionality of both a previously unknown battery and its host device is enhanced, without permanent reconfigurations to either the battery pack or host device.

(f). The connector assembly can be used as a replacement for an existing input power jack, with minimal modifications or rewiring.

(g). Problems with the existing multiplicity of connectors on electronic devices that allow incompatible external adapter output voltages are eliminated. Instead, the receptacle is simply wired in a different configuration, and a distinctive plug is used to differentiate the two incompatible external adapters. Any fear of possible mismatched voltages between external power adapters and host devices is eliminated.

(h). This embodiment of the connector assembly uses an insertable "jumpered" terminator plug to reinstate a circuit, so the need for an ON/OFF power switch in conjunction with a power input jack is eliminated. The terminator plug is configurable to turn the host device ON when the plug is inserted into a receptacle.

(i). The plug and receptacle of the connector assembly provide a retention mechanism that secures the mated assembly—an important feature for devices like laptops that are often moved around the local area in industrial or service applications.

(j). In certain high-risk environments, host devices that automatically charge their batteries when external power is applied can be easily modified by inserting a battery pack that has been upgraded to the connector assembly. Thus configured, the battery does not charge, and thus powering the host device is rendered safety compliant.

(k). Simultaneous battery monitoring and power delivery from an external peripheral is achieved without modifying the internal circuitry of the host device.

(l). By installing a means of controlling the direction of signal flow, e.g., a switch that responds to applied power signals, a diode, etc., located at either the plug or receptacle of the connector, battery monitoring and power delivery can occur with a two-conductor cable.

(m). Monitoring battery charging is performed by an external device attached to a connector assembly as defined herein, which is further capable of power delivery, data transfers (or both).

Applications

A battery pack upgraded with the subject receptacle creates new electrical paths for power and/or data when a configurable plug is inserted (or removed) enabling applications such as (but not limited to) the following:

1) Diminish excessive and unnecessary charging of a battery when attaching an external power source. By not charging a battery every time a host device is connected to an external source of power, the life expectancy of the battery is increased. Since most rechargeable battery-powered electronic devices automatically charge their batteries when external power is connected, the use of a connector assembly that disables the battery charge function increases the useful life of the battery, thus reducing total operating cost.

2) Some applications may not find battery charging practical. Battery charging can consume 20–40% of the entire load schedule of a host device's available power. If a car's battery is low, operating a host device such as a laptop for an extended time from the dashboard outlet could result in a stranded motorist.

3) Some transportation locations may not allow for battery charging. There is risk in charging batteries, especially high-density Li-Ion cells. An airline or cruise ship operator, for example, may wish to limit the risk of an onboard battery-related fire or explosion. A simple and cost effective method is to deploy battery packs and power cords that have a connector assembly which disables the charge function, while still allowing an external power supply to power the host device.

4) Extended-run-time external battery packs can be used to supplement a host-device's associated battery. These extra-high-capacity battery packs connect to a host device's existing power-input jack. So configured, the external battery pack dedicates some of its stored energy to charging the host device's battery. This occurs because host systems are designed to charge the associated battery whenever external power is available. As a power source, a host device usually does not distinguish an external battery from an AC/DC wall adapter, so the extended-run-time battery loses its effectiveness by having to relinquish some amount of its stored energy to charging the host's battery. By using a connector as described herein, the extended battery routes its power along a new circuit which bypasses the host device's existing battery pack. By doing so, the charging circuits within the host device are temporarily disabled while the external battery source is in use. This enhances the run-time of the external battery, and also eliminates inefficient energy transfers between the two batteries.

These non-limiting examples of applications for connector assemblies such as those described in this document thus show some practical real-world uses.

Design Parameters

Some of the connector design parameters required to achieve the above-defined applications are:

1) Small package size, especially for the receptacle, since available space within battery packs is limited.
2) Straightforward method of integrating a receptacle into an existing battery pack, or for installing the receptacle in a new battery pack design in a way that doesn't require an inordinate amount of extra tooling or assembly.
3) Inexpensive
4) Simplicity of use

SUMMARY OF THE INVENTION

This invention relates to an apparatus for a power and/or data I/O port, specifically connector assemblies which have conductors, insulators and related elements that create different electrical paths than had previously been present in electrical and electronic devices. These newly-created electrical paths enable devices and peripherals to perform power and/or data functions in ways they could not without such an apparatus. By locating a connector assembly of the invention in replaceable modules, such as battery packs, users can upgrade and enhance the functionality of a multiplicity of existing (and future) electronic and electrical goods.

DETAILED DESCRIPTION OF THE INVENTION

Figure 1:
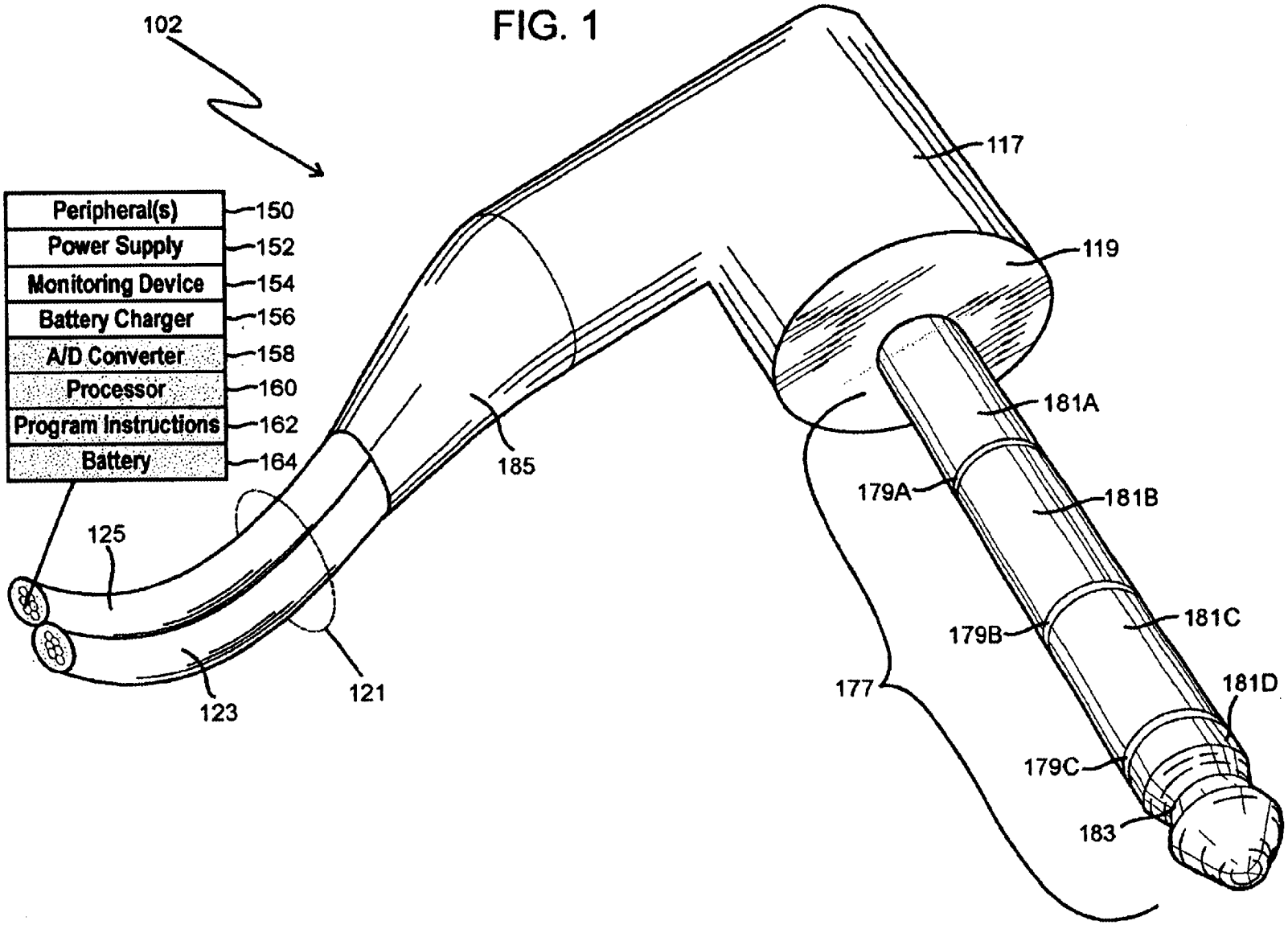
FIG. 1 depicts a multi-segmented pin-style connector plug which is capable of reconfiguring power (and/or data) paths.

The invention provides a connector assembly for transferring electrical signals including power and input/output information among multiple electrical devices and their components. In the following description, numerous specific details are set forth in order to provide a more thorough understanding of the present invention. It will be apparent, however, to one skilled in the art that the present invention may be practiced without these specific details. However, in order not to unnecessarily obscure the invention, all various implementations or alternate embodiments including well-known features of the invention may have not been described in detail herein.

Theory of Operation

In certain modalities of the invention, the concept of "Dominant Voltage" is applied as a means of delivering power to a battery-powered device. The configurable connector assembly illustrated herein is highly customizable to simultaneously attach a multiplicity of peripherals to both a battery and its host device along a minimal number of conductors. By such configuring, the battery is immediately available to the host device should the attached power supply peripheral be turned off or fail. This provides a simple, yet effective, uninterruptable power supply capability.

Incorporating a means of controlling the direction of signal flow allows battery signals to flow to the attached power supply, but no signal from the power supply can flow to the battery, yet the output of the power supply does flow to the host device that was previously powered by the battery. The power supply is thus able to acquire power (and/or data) signals from the battery, which are essential to configuring the output of the controllable power supply. The power supply's output is determined by computations primarily based on acquired battery voltage. Thus, if the configurable power supply is acquiring voltage values from a 12-volt battery, the power supply's output will be a value in the 12-volt range.

As discussed, since both the battery and the power supply are connected and accessible to the host device, then a method must be established to make sure that the power supply, and not the battery, is the primary source of power. The concept of Dominant Voltage comes into play when two similar power sources are connected to a load. An example is a 12-volt light bulb to which are attached two 12-volt batteries, each battery being connected to the light bulb by a separate set of conductors. Assuming that the two batteries are not exactly matched in output, e.g., one of the batteries is further discharged than the other, the battery that is more deeply discharged will output a slightly lower voltage than the other. Dominant Voltage would result in the battery with the most charge—higher voltage—delivering power to the light bulb.

This concept is well-recognized in the battery industry, where matching cells (often referred to as "cell balancing") in a battery pack is commonplace with Li-Ion batteries. Even with older battery chemistries, a superior or inferior cell in a pack is recognized as significantly undesirable.

In applying the Dominant Voltage concept to the subject invention, if the means of controlling directional signal flow is a diode, the acquired battery voltage is depressed. Because the anticipated voltage drop of a known diode is available to a processor that has access to the power supply, all computations take into account the voltage drop caused by the diode. The computations are also biased to yield a resulting voltage value that is higher than the acquired battery voltage. This higher voltage ensures that the power supply, instead of the battery, is the primary source of power to the target device.

A bleed resistor across the diode will allow a non-diode-depressed voltage to be available to the external power supply. This eliminates the need to calculate out the error of the diode's voltage drop. This bleed resistor approach can be used in some other diode applications discussed throughout this document.

The connector assembly of the invention accesses the host device at its original battery terminals (typically, these terminals are contacts located in a battery "bay"), and corresponding contacts at the battery housing mate when the battery pack is inserted into the battery bay. By delivering power at this battery-to-host interface, a significant and previously unrecognized advantage is gained. Because battery output voltages fluctuate wildly—from 4+ volts above the cell's rated design voltage, to 3+ volts below that rated voltage—the internal circuitry of the device is designed to operate across a wide range of input voltages. A freshly charged battery label-rated at 12-volts will output 14–16 volts when freshly charged, and a 12-volt battery's design shut-down voltage can be as low as 9 volts. Thus, a properly designed device that uses a 12-volt battery will operate within an input voltage range at its battery I/O from 9 to 16 volts.

On the other hand, that same device's input voltage requirement at its external power I/O port (the "jack" to which AC/DC power adapters attach), typically will have a narrow +/− 1-volt input tolerance. Thus, the connector assembly of the invention achieves its maximum potential when interfacing external devices at the battery-to-device circuit, even though the design of the connector embodiments herein are quite well suited as replacements for the traditional power-port jack. One of the major benefits achieved is that the external power supplies do not have to be built to exacting critical output-voltage tolerances. Lower cost power supplies are the result.

The connector assembly configurations wherein both the external power supply and the battery have access to the host device along shared conductors, the output voltage of the power supply will be greater than the output voltage of the battery. If not, the battery's higher voltage will be dominant, and the battery will power the host device, instead of power coming from the external power supply. The Dominant Voltage effect allows the battery's power signal to immediately become available, should the external power supply ever lose power. Thus, the host device's battery remains a viable alternative source of power, even when the plug is still inserted in its mating receptacle.

In summary, a configuration of three interconnected devices wherein a battery and an attached power supply are both available to deliver power to a host device, ensures that the power supply is safely configured at a higher voltage than the battery's typical voltage, which allows the concept of Dominant Voltage to play a significant role in ensuring that the power supply—not the battery—is the primary source of power.

Dominant-Voltage Effect: An Example

Figures 2A, 2B:
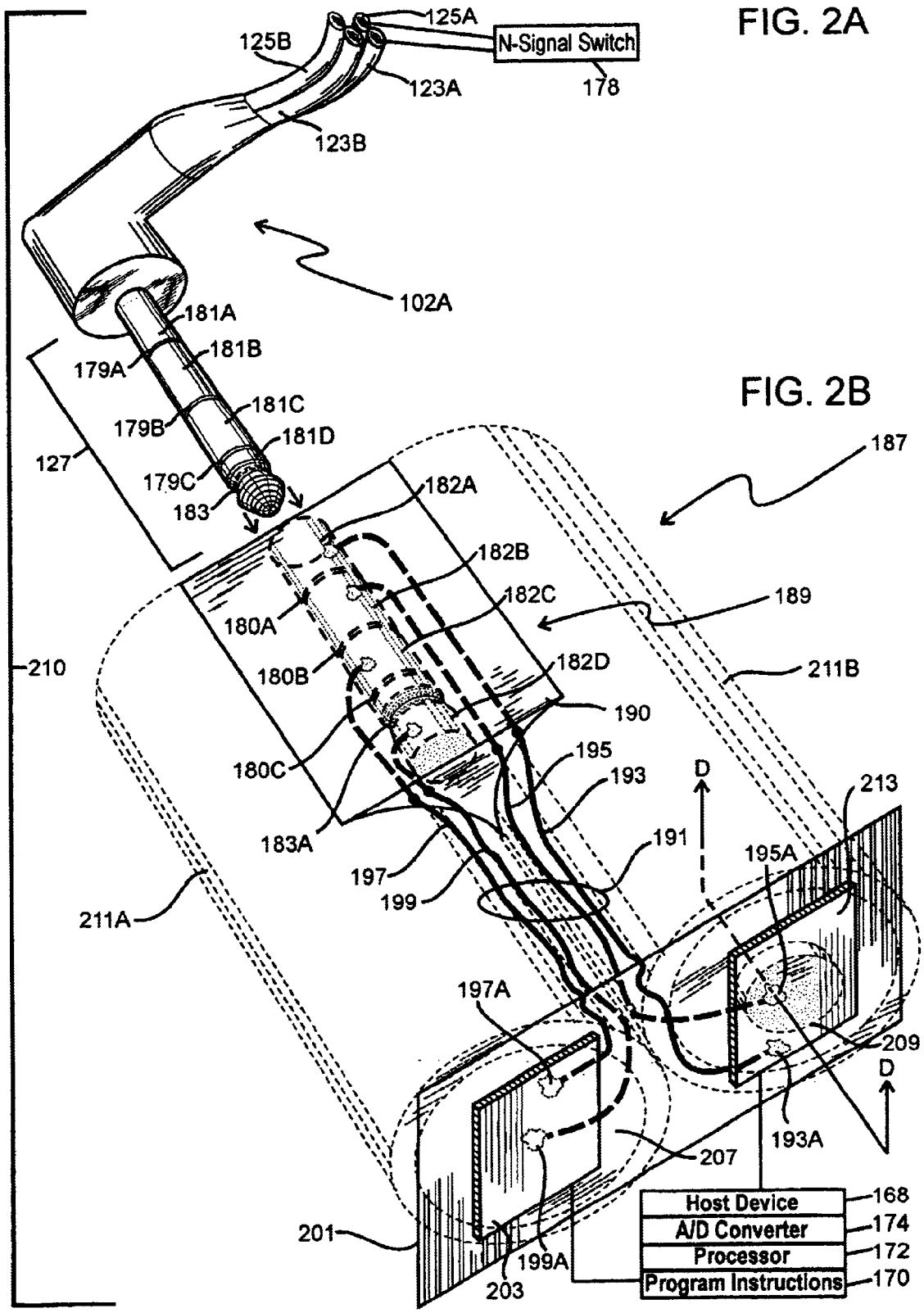
FIGS. 2A and 2B show a multi-segmented pin-style connector plug similar to that of FIG. 1, and its associated receptacle installed at a simplified battery cell cluster, within which various electrical circuits have been created.

The output voltage of an external power supply 152 (FIG. 1) has to be greater than the output voltage of battery 187 (FIG. 2B). If not, battery 187's higher voltage will be dominant, and the battery will power the host device, instead of power coming from the external power supply 152 (FIG.

1). The Dominant-Voltage effect allows battery 187's power signal to immediately become available through an N-signal switch 178 (FIG. 2A), should the external power supply ever lose power. Thus, the host device's battery 187 remains a viable alternative source of power, even when plug 102A is still inserted in its mating receptacle 189.

The power supply, which includes a voltage-comparator circuit, configures its output voltage according to one or more acquired power-related parameters. There may be an A/D converter, so that acquired analog information can be output to a controller/processor which configures the power supply's output.

In FIGS. 2A and B, once an external power supply 152 has acquired voltage information from a battery 187, the power supply configures its output voltage according to the optimal power signal parameters it has acquired from the battery, then delivers that power signal to the host device 168. Starting at battery 187, the positive (+) power signal flows to receptacle contact sleeve 182B. Since plug 102A is inserted, pin segment 181B transfers the signal at receptacle sleeve 182B through an N-signal switch 178 that controls the direction of flow of the power signal to be only from plug pin segment 181B to plug pin segment 181A. Pin segment 181A is attached to power supply 152 along conductor 123B.

From the power supply 152, a positive (+) power signal travels to plug pin segment 181A, where the N-signal switch opens the electrical path to pin segment 181B and, instead, closes the path to receptacle sleeve 182A, which is electrically available to host device 168 along receptacle conductor 193 to contact pad 213.

The ground line (−) is shared by both the battery and the host device at receptacle sleeves 182C and 182D, which are electrically coupled together by a jumper (shunt) in plug 102A across pin segment 181C and pin tip 181D. Since the configurable power supply 152's output operates within the same voltage range as that of battery 187—with which it shares a conductor—eliminating one of the four plug conductors is appropriate in this application. Only conductor 125B is required for the ground signal.

In order to provide a means of transferring backup power from battery 187 to device 168, should power supply 152 not be turned on, the shunt that couples receptacle sleeves 182C and 182D allows the ground signal to flow from battery cell 211A, along conductor 199 to plug pin tip 181D, then across the shunt to pin segment 181C. From pin segment 181C the signal transfers to receptacle sleeve 182C, then along conductor 197 to contact pad 203, which is accessible to host device 168.

The positive (+) signal flow in a state of the power supply 152 being turned off, the signal from battery cell 211B's terminal 209 travels along conductor 195 to sleeve 182B. Then the signal transfers to mated pin segment 181B, where the N-signal switch automatically first opens a circuit directed to plug conductor 123B, and also closes a circuit between pin segments 181B and 181A, so that the positive signal from battery 187 now transfers from pin segment 181A to receptacle sleeve 182A and, further, the signal now continues along receptacle conductor 193 to contact pad 213, which is accessible to host device 168.

The N-signal switch operates whenever a power signal is received at its selected pin outs, so that a power signal from a battery or an attached power supply causes the switch to automatically open or close designated circuit paths. As configured here, should the power supply be off, switch 178 uses power signals from the battery to close the battery-to-host circuit, while also opening the power supply-to-host circuit. When the power supply is on, its power signal at the switch causes the switch to alter the circuits accordingly. More description of N-Signal switches is in the section "Cables and Muxes."

Diodes can also be used in place of the N-signal switch. With diodes, the contention issues on shared conductors or contacts takes some planning so as to avoid a voltage drop from having a diode in the circuit. Voltage drops can be avoided with careful placement of the diodes, and also by relying on the Dominant Voltage principle. As discussed, as long as power supply 152 outputs a signal at a higher voltage than battery 187, the only power signal received by the host device 168 is that of the power supply.

If a diode is to be placed in the circuit, it should be located in the plug, instead of the receptacle, so that the diode disappears from the circuit when the plug is retracted. Note that either diodes or N-signal switches can be incorporated in a plug, or in the circuits created in, to, or from a receptacle.

Since the subject connector assembly of the invention employs a discrete "jumper" plug (not shown) which replaces plug 102A in FIG. 2A when external power is not in use, the jumper plug pin segments 181A and 181B are simply electrically coupled, as are pin segments 181C and 181D in order to re-establish a circuit between battery 187 and its host device 168.

Principles of Operation

The principles of operation of a connector assembly that is the invention are important to defining individual implementations of the mechanical and physical connector of the present invention.

A non-limiting example of an operation of a multi-segmented "pin-style" plug, and its mating receptacle, is to provide a means of reconfiguring electrical (power and/or data) circuits so that devices external to a host device and its associated battery perform functions as if they were embedded in the device. Also, electrical signals from peripherals address specific device sub-systems which, without such a connector assembly, would be inaccessible to external peripherals. As in the "Theory of Operation" section above, mating the plug and receptacle creates an operational "Y"-connector that temporarily disrupts and reconfigures a host device's original internal circuits (e.g., an internal battery charger). Such a "Y"-connector can be used, for example, to monitor one or more activities of a host device (or its sub-systems) by isolating and redirecting the I/O port of that sub-system for purposes such as monitoring, powering, or sending/receiving data.

An example of a specific connector assembly operation is to disrupt the power circuit between a host device and its battery. This disruption may be necessary because battery charging is not deemed appropriate at the time, or in a specific location, yet external power to the device is needed. As in the example cited in the previous Dominant Voltage discussion, the host device 168 (FIG. 2B) is temporarily disengaged from its battery 187, so that an external power supply 152 can, by accessing the battery independently, power the device directly. In the "Y"-connector metaphor, the power supply is at the base of the "Y," and the battery and host device are at the terminuses of each of the upper branches. Yet, by implementing a means of controlling the direction of signal flow 178 and a simple shunt, the battery remains available to the host device (see previous section).

In another example, perhaps an external power supply is input-side limited because it is drawing power from an upstream generator source (or being powered by a weak car battery while the engine isn't running). These limited power resources may not provide sufficient power reserves to both operate the host device, and simultaneously charge the host's battery. As has been previously discussed, connecting power to a host device's standard input-power I/O port (jack), always causes the device's internal battery charger to turn on. But, by accessing the host device with the connector assembly of the present invention interposed at the existing battery-to-device interface, battery charging is disabled, and power-limited resources are conserved.

Upgrade Paths

The capabilities of multi-segmented connectors allow multiple simultaneous functions to be performed with a host device, its battery, and various peripherals, without requiring numerous complex interfaces. One connector assembly can deliver significant upgrades to electrical or electronic equipment for operations that were not originally designed into the device. Upgradability can be achieved simply and cost effectively by locating the connector assembly and related wiring in a removable (or easily field-replaceable) module. For example, since rechargeable battery packs are user-removable, incorporating a connector in a battery housing provides a convenient means of modifying electrical circuits, both in the battery and, as a consequence, the battery's host device.

A complete battery pack is not specifically shown in the figures, but it is the preferred installation location. FIG. 2B shows at least a partial view of where and how to install the receptacle of the subject connector assembly. Another advantage of battery-mounting a receptacle 189 is that a host-device manufacturer can inexpensively upgrade a user's battery pack with one having a receptacle installed.

Connector assemblies of the invention may be integrated into a host device at the time of manufacture and the top flat surface of a receptacle 189 can be secured to an adjacent wall in a corner of the device. Upgrades to install a receptacle, or an equivalent, in an already manufactured host device can be performed by qualified field service technicians. Supplemental conductors would be installed to connect the receptacle to existing host device circuits, or the circuit boards would be replaced. However, the intent of connector assemblies discussed herein is to not have to modify existing host devices but, instead, to install the receptacle in a replaceable module, such as a battery pack.

FIG. 2B reasonably portrays an actual battery pack. The element 201, which is referred to herein as an insulated barrier is also the element in a battery pack that would be the exposed face of the enclosure (housing), with the two exposed contact pads 203 and 213 insulated from the battery cells by the plastic face material of insulating barrier element 201. Further, the four conductors 193, 195, 197 and 199 would already be in place at the time of manufacture. These respectively attach at electromechanical bonding points 193A, 195A 197A, and 199A to contact pad 213, battery terminal 209, battery terminal 207, and contact pad 203. To install the receptacle of the present invention, one only has to cut the original two conductors (here as first conductor set 193 and 195, and second conductor set 197 and 199) and insert the receptacle module 189 into the V-shaped valley between the two adjacent cylindrical cells 211A and B. The receptacle module 189 is held in place either by affixing it to the top face of the battery enclosure (not shown) with glue or double sided tape. Flexible glue, or double sided tape, can also be used to affix the receptacle module 189 directly to the cells. Electrically attach each of the four conductors to appropriate sleeve contacts 182A through D. Create a hole in the back face of the battery enclosure (not shown) so that the plug's pin assembly 127 can access the receptacle, and the installation is complete.

Figure 3:
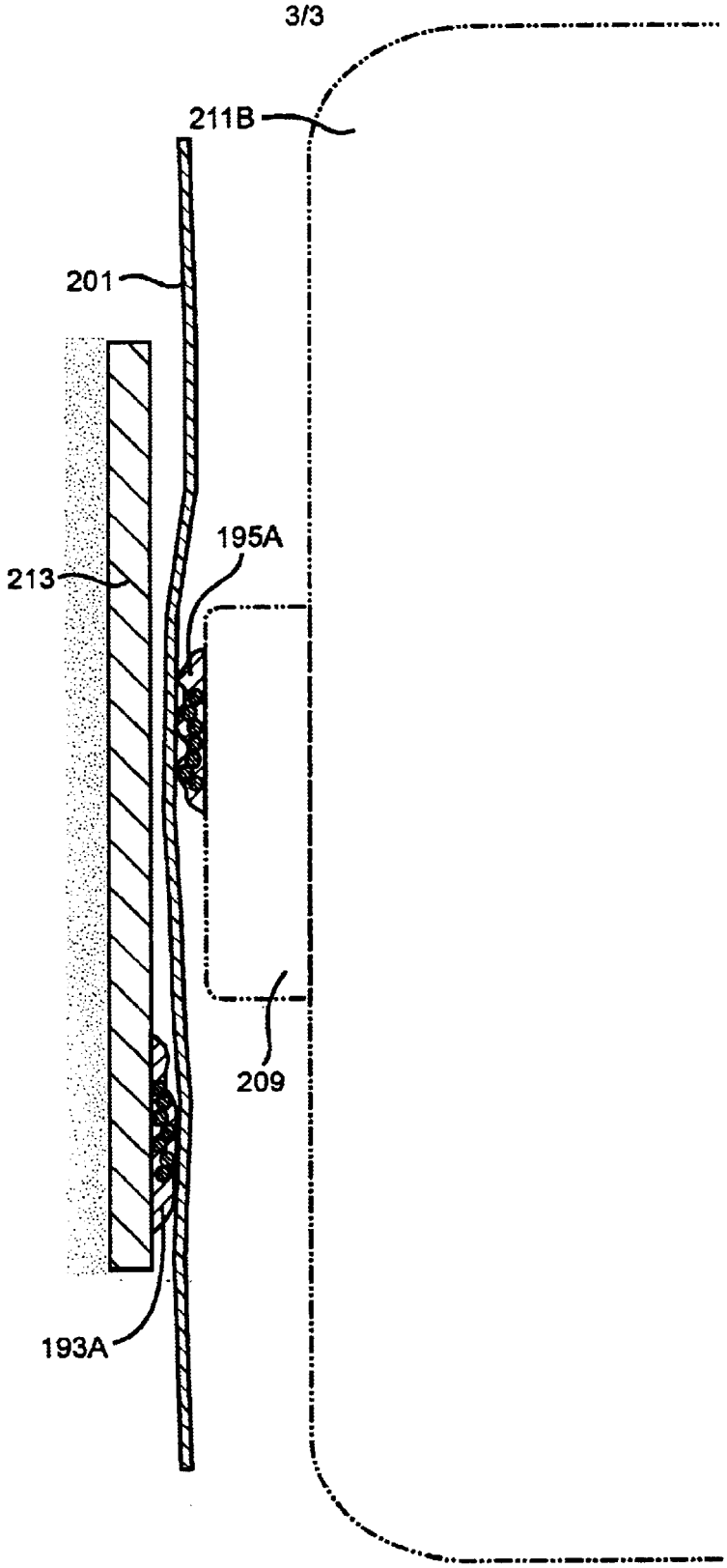
FIG. 3 is a cross-sectional view relating to the conductor and insulator arrangement in FIG. 2B, showing the detail of a battery terminal, an insulator, and the connections of conductors.

FIG. 3 depicts a cross-sectional view of battery 211B (see FIG. 2B), with insulator barrier 201 interposed between battery cell terminal 209 and conductive contact pad 213. The insulator material is slightly flexible and, as shown here, is mildly deformed by the protruding electromechanical attachment points of conductor terminuses 193A and 195A. The plastic battery housing wall is not shown here. It often replaces the insulator barrier 201 for electrically isolating the battery terminals from the external contact pads.

Contact pad 213 is somewhat representational of the typical exposed battery contacts that are usually located on the face of one of the side walls of the battery enclosure. When the battery pack is inserted, these contact pads engage aligned spring clips located in the recesses of the battery bay (cavity). This battery-to-host-device I/O port is an ideal interface at which to electrically interpose external peripherals into existing battery and host device circuits, by means of a connector assembly of the present invention.

The connector assembly is not limited to battery housings or mounted in host devices . . . other removable sub-systems or modules, such as the external AC/DC power adapter normally purchased with a host device, also afford upgrade opportunities as locations where such a connector assembly may reside. This external installation approach is more appropriate to battery-powered tools, flashlights, and the like.

Connector assemblies discussed in this document, as well as non-limiting referenced alternative modalities, are capable of establishing a "Y"-connector circuit that interrupts an existing mode of operation. Restoring the device's original circuits and operations once the plug of the subject pin-style assembly 177 is retracted is by means of a "jumpered" terminator plug. Referencing FIG. 2A, a jumpered plug to replace plug 102A has a pin assembly 127 physically configured exactly like that shown here. The jumpering is achieved by using internal shunts to cross-connect the four conductive pin contact segments 181A, 181B, 181C, and 181D. The first shunt electrically couples pin segment 181A to 181B. Referencing the conductive sleeve segments of mating receptacle 189 (FIG. 2B), when the jumpered version of plug 102A is inserted into receptacle 189, coupled pin segment 181A and 181B electrically join corresponding receptacle sleeve segments 182A and 182B. In doing so, an electrical circuit is closed.

That circuit starts at battery cell 211B's positive terminal, which is attached to conductor 195 that is attached to receptacle sleeve segment 182B. A signal from battery cell 211B that transferred along the electrical path just described is now at sleeve segment 182B, where it transfers to inserted plug 102A's pin segment 181B, then along the shunt (not shown) to pin segment 181A. Pin segment 181A is engaged to receptacle sleeve segment 182A, so the battery cell signal now transfers from segment 182A along conductor 193 to contact pad 209, which is accessible to a host device 168.

The jumpered plug also has a shunt that electrically couples plug 102A's pin segments 181C and 181D. When the plug is inserted into receptacle 189, the electrical path that starts at battery cell 211A's negative terminal flows along conductor 199 to sleeve segment 182D where, because plugs pin segment 18 ID is engaged to sleeve segment 182D, the signal is transferred to the plug, wherein it travels along the shunt from pin segment 181D to pin segment 181C. Pin segment 181C is engaged to sleeve segment 182C, so the signal transfers thereto, then flows along conductor 197 to battery pack housing contact pad 203, which is accessible by the host device. In the process just described, inserting a jumpered plug (not shown) into a receptacle 189 results in reconnecting a battery pack 187 with its host device 168. The jumpered plug thus serves to electrically recouple a host device and its battery to the original "as-manufactured" electrical configuration.

Note that the insulated barrier 201 electrically isolates battery cell 211A's terminal 207 from contact pad 203. Contact pad 203 is representational of the style of contacts often found on the exterior face of a removable battery pack's housing (enclosure). When the battery pack is installed into the battery "bay" (cavity) of a host device such as a laptop computer, contact pad 203 engages a mating spring-contact inside the battery bay, thereby creating a circuit between the battery pack 187 and its battery-powered host device 168.

In understanding the circuits shown in FIGS. 2A and B, it is apparent that the connector assembly 210 serves to disengage a battery from its host device when no plug is present. Further, when a plug 102A is inserted, the battery and its host device are accessible on discrete conductors, so that either only the battery is addressed, or only the host device. Since the battery is electrically isolated from its host device when a plug 102A is inserted, external peripherals inter-connected at the plug, are able to access either a battery 187, or its host device 168. Later, the introduction of a means of controlling the direction of signal flow 178 in the circuits will enable both the battery and an external peripheral to mutually co-exist in the same circuit.

Most connector assembly embodiments herein allow for additional operations, such as "hot insertions." By the location, selection, and wiring of the plug's conductive segments along its pin-style shaft, staging electrical contacts is achievable, so that one contact is electrically active prior to a second contact. Strategic placement of insulators and their width and spacing in relation to the conductive segments in the plug and receptacle provide circuit disruption, rerouting of electrical paths, and the creation of "Y"-connector electrical branches within existing circuits.

The most flexibility is achieved by the attachment of conductors, as well as their relationship to anticipated operations of the inter-connected sources, devices, and peripherals.

Multiple operating modes allow for operations similar to those of a multi-selector switch. Each branch of a "Y"-connector (or both together) can be used as either data or power paths, or as combined mixed-signal circuits, by interchanging plugs that are each configured to perform specific tasks.

Connector Concepts

The circuits created in configuring conductor attachments at a receptacle 189 in FIG. 2B, in combination with conductor configuration at a mating plug 102A (FIG. 2A), or 102 (FIG. 1), results in a "Y"-connector that interfaces peripheral apparatuses (elements 150–164 in FIG. 1), a host device 168, and the device's battery 187.

In concept, certain interconnecting configurations are diagrammatically more a "T"-connector than a "Y"-connector. For clarification, herein a "T"-connector does not disrupt an existing electrical circuit, while a "Y"-connector typically disrupts, redirects, and/or creates new electrical paths.

An example of a "T"-connector is an external monitoring peripheral attached to an existing circuit between a "smart" battery and its data-enabled host device, in order to monitor data signals being bi-directionally transferred between the battery and its host device. Conceptually, in this "T"-connector configuration, the interface apparatus of the present invention is located at the intersection of the top and base bars of the "T," and electrical signals flow along the horizontal top bar of the "T," from a battery located at one terminus of the top bar, to a host device located at the other terminus of the top bar of the "T." An external peripheral is located at the base of the vertical bar of the "T," and is attached by the plug of the connector assembly to the receptacle at the intersection of the vertical and horizontal bars of the "T." In "T"-connector configurations, the attached peripheral has operational functions that are typically limited, such as here monitoring the signals being transferred between the battery and its host device. Thus, this example of a "T"-connector does not disrupt an ongoing inter-device operation.

"Y"-connectors implicitly have an attached peripheral(s) that is interactive, i.e., performing more than passive monitoring operations. By example, the previously cited monitoring peripheral operates through a "T"-connection because the attached apparatus is only monitoring an ongoing signal-transfer operation.

However, when that same monitoring apparatus is integrated with a configurable power supply as a single attached peripheral, a "Y"-connector configuration occurs. With the connector assembly at the juncture of the three branches of the "Y," the battery at the terminus of one of the top branches has its signal flow down the branch, through the subject connector, then down the vertical branch to its base where the attached monitor/power supply peripheral is. Because the conductor attachments of the connector assembly's plug and receptacle are configured differently than for a "T"-connector, the original battery signal is now disrupted to the host device (albeit, the battery signal will technically continue to flow to the host device until the output signal of the power supply overrides it, causing the battery signal to be disrupted).

The battery signal is received by the monitoring element of this multi-function peripheral but, that signal is now used to configure the output signal of the power supply element, so the monitoring element is now performing more than simple monitoring . . . it is also diagnosing a received signal—more complex operations usually point to "Y"-connector rather than "T"-connector configurations. The power supply element delivers power, so it has an implicit interactive operation, which is another indicator of a "Y"connector configuration, instead of a "T"-connector.

To continue the metaphor, the power supply at the base of the vertical bar of the "Y," is now the source of power for the host device, instead of the battery. The outputted power signal flows from the power supply peripheral upward along the vertical bar to the connector assembly at the juncture of the base branch and the two top branches of the "Y." The configuration of the plug's pin segments and conductors includes a means of controlling the direction of signal flow which both causes the battery signal to flow only downward along the vertical bar of the "Y" to the peripheral but, also, prevents the power supply's signal from traveling up the branch to which the battery is attached. The power signal only flows from the power supply to the host device along the other branch. Thus, the "Y"-connector configuration does disrupt existing circuits, redirects signals, and creates new electrical paths.

Turning to the present interface apparatus and its various possible configurations of contacts and conductors, two non-limiting connector configuration models are detailed, one representing a "T"-connector, the other a "Y"-connector.

"T"-Connector

In a "T"-connector configuration, it is not essential to the proper operation of the connector assembly 210 (FIGS. 2A and B) that all conductive plug pin segments 181A, 181B, 181C, and 181D be attached to conductors 123A and B, and 125A and B. Even though there are sufficient plug and receptacle contacts to accommodate a four-conductor interface, the simple operation being described here of an attached monitoring device 154 accessing signal transfers from a battery 187 to a host device 168 requires only two conductors.

To define the horizontal top bar of the "T," battery cell 211A (FIG. 2B) is attached by a conductor 199 along which its negative signal flows to receptacle's contact sleeve 182D. Since the plug for attaching the peripheral is not yet engaged to the receptacle, a jumpered plug (not shown) is inserted into the receptacle. This jumpered plug closes circuits that are left open when no plug is inserted. The battery signal at sleeve 182D transfers to the plug's conductive tip segment which is jumpered to the adjacent pin segment, so that the signal then transfers the negative signal to receptacle sleeve 182C then, finally, the signal flows along conductor 197 to contact pad 203, which is accessible to the host device 168 (FIG. 2B).

In lieu of a jumpered plug to reestablish a direct circuit between battery 187 in FIG. 2B and its host device 168, conductors 123A, 123B, 125A, or 125B to external peripherals 150 can employ an electrical or mechanical switch 178. This switch closes the electrical loop when external devices are turned off (but left connected). For example, a controllable switch (microcontroller) 178 in FIG. 2A is located in the external peripheral that closes when the attached apparatus is in an OFF state. To truly eliminate the need for a jumpered plug, the switch should reside in the receptacle side of the circuit, since placing a switch on the peripheral side results in the switch going away when the peripheral apparatus does.

The positive signal from a battery cell 211B (FIG. 2B) that flows along the top bar of the "T" starts with the signal traveling along conductor 195 to receptacle sleeve 182B, where the signal is then transferred to the jumpered plug's equivalent of pin segment 181B. Since the jumpered plug is inserted into the receptacle, the signal then follows a jumper that electronically couples pin segment 181B to its adjacent equivalent segment 181A. From pin segment 181A, the signal transfers to receptacle's sleeve 182A, which is attached to conductor 193 to contact pad 213, which is accessible to host device 168.

Thus, the flow of both a positive and a negative signal are transferred from a battery, across the horizontal top bar of a metaphorical "T"-connector, to a host device.

To attach a monitoring peripheral 154, the addition of which will create the vertical bar of this metaphorical "T"-connector, the jumpered plug described above is removed, to be replaced by a plug 102 (FIG. 1) that is attached to the peripheral by a cable 121 with two conductors 123 and 125.

To now redefine the signal flow of a battery 187 (FIG. 2B) in a complete "T"-connector configuration, the negative signal flows from cell 211A's terminal 207 first along conductor 199 to receptacle's contact sleeve 182D. Since the plug 102 (FIG. 1) for attaching the peripheral is now engaged to the receptacle, the battery signal transfers from sleeve 182D to plug 102's pin tip 181D, to which is attached cable conductor 123 that directs the negative signal to external monitoring peripheral 154 (FIG. 1).

But, according to the "T"-connector metaphor, the host device 168 is also supposed to receive the negative battery signal. This is accomplished by a simple shunt that electrically couples plug's pin tip 181D with pin segment 181C. Thus, the battery's negative signal also flows from pin tip 181D to segment 181C, where receptacle sleeve 182C engages pin segment 181C and the signal then transfers to sleeve 182C, then travels along conductor 197 to contact pad 203, which is accessible to host device 168 (FIG. 2B).

Note that plug's pin segment 181C attaches the cable conductor 123 (to peripheral), the shunt that jumpers together pin segment 181C with pin tip 181D (to battery), and the receptacle conductor 197 (to host device). Pin segment 181C is the literal juncture of the horizontal and vertical bars of the metaphorical "T," where the signals branch in three directions: to the peripheral, the battery, and the host device.

The positive signal from a battery cell 211B (FIG. 2B) first flows along conductor 195 to receptacle sleeve 182B, where the signal transfers to plug's pin segment 181B. Since plug 102 (FIG. 1) is now inserted instead of the previous jumpered plug, the signal travels along cable conductor 125. Plug's pin segment 181B has two attached conductors. The first is conductor 125 of cable 121 (FIG. 1), which directs the positive battery signal to the attached monitoring peripheral 154. Conductor 125 is the metaphorical equivalent of the vertical bar of the "T." The second conductor attached to plug's pin segment 181B is a shunt that electrically couples pin segment 181B to segment 181A, so that the signal available at pin segment 181B is now also available at pin segment 181A. From pin segment 181A, the signal transfers to mated receptacle's conductive sleeve 182A and, from there, the positive signal that originated at the battery then flows along conductor 193 to contact pad 213, which is accessible to host device 168.

Thus, the original flow of signals from a battery 187 (FIG. 2B) to a host device 168 along the horizontal top bar of the "T"-connector is still uninterrupted and is not redirected. By attaching a monitoring peripheral 154, the battery signals are transferred to both the host device and the peripheral.

"Y"-Connector

Turning to the "Y"-connector modality of the connector assembly, it differentiates itself from a "T"-connector by disrupting one or more existing circuits, redirecting signals (not simply a signal splitter, as is the "T"-connector), or by creating new electrical paths. The plug and receptacle configuration presented here is for comparison to the above-detailed signal flow paths of a "T"-connector configuration. Here, an external monitoring device 154 (FIG. 1) and a configurable power supply 152 are treated as one attached apparatus, the monitoring device representing signal flow from a battery 187 (FIG. 2B), and the power supply representing signal flow from it to a host device 168 (FIG. 2B). For simplicity, a plug 102A with a four-conductor cable in FIG. 2A is used, although a three- or even two-conductor cable achieves the same result when a means of controlling the direction of signal flow is incorporated into one of the electrical paths.

The negative signal of a battery cell 211A (FIG. 2B) first travels along conductor 199 to receptacle's contact sleeve 182D. Since the plug 102A (FIG. 2A) for attaching the peripherals is now engaged to the receptacle, the battery signal transfers from sleeve 182D to plug 102's pin tip 181D, to which is attached cable conductor 123A that directs the negative signal to external monitoring peripheral 154 (FIG. 1).

The positive signal from a battery cell 211B (FIG. 2B) first flows along conductor 195 to receptacle sleeve 182B, where the signal transfers to plug's pin segment 181B. Since plug 102 (FIG. 1) is now inserted instead of the previous jumpered plug, the signal travels along cable conductor 123B to external monitoring peripheral 154.

Notice that plug 102A does not have the shunts that were used in the "T"-connector version, those shunts being used to continue the electrical path from the battery to the host device. In the "Y"-connector, the electrical paths between the battery and its host device are disrupted, and battery-signal flow is redirected from the host device to the attached external peripheral.

Having defined the outbound circuit path from the battery to an attached monitoring peripheral 154, the inbound path from the external power supply to the host is yet to be established. The negative signal from a configurable power supply 152 (FIG. 1) starts flowing along conductor 125A (FIG. 1A) to its terminus at plug 102A's conductive pin segment 181A (FIG. 2A). This segment is aligned and electrically engaged to receptacle 189's conductive sleeve 182A (FIG. 2B), causing the power supply's negative signal to transfer from pin segment 181A to sleeve 182A and, then the signal travels along receptacle conductor 193 to contact pad 213, which is accessible to host device 168.

Thus, the negative signal from an attached power supply flows to a host device along contacts, and conductors that are totally separate from the electrical path between the battery and the attached monitoring device.

The positive signal from the power supply 152 (FIG. 1) to host device 168 (FIG. 2B) starts out traveling along conductor 125B (FIG. 2A) to its terminus at conductive pin segment 181B of plug 102A. When the plug is mated to receptacle 189 (FIG. 2B), pin segment 181B is electrically engaged to the receptacle's conductive sleeve 182B, to which the power supply's signal now transfers, after which the signal lastly travels along conductor 197 to contact pad 203, which is accessible to host device 168 (FIG. 2B).

This example of a "Y"-connector configuration is simplified. With a four-conductor arrangement, one pair of conductors—123A and B—is dedicated to the monitoring peripheral, while the other pair of conductors—125A and B—is dedicated to the power supply. What is missing is a means of having the battery re-engage the host device when the power supply is in an OFF state. The N-signal switch 178 in FIG. 2A resolves the issue by coupling negative conductors 123A and 125A if no power flows from power supply 152. A second N-signal switch at conductors 123B and 125B can be added. See the section "Cables and Muxes" for more information on this type of switch. The section also explores ways to eliminate one or more of the four conductors used in this example of a "Y"-connector configuration.

Diodes, in conjunction with shunts, that strap across pin segments 181A and B, as well as across 181C and D, will prevent signals from the power supply flowing onto the battery conductors 195 and 197, but will allow power from the battery cells to flow to the host device whenever the power signal from the power supply is not present. If diodes are to be used, refer to the section herein Dominant Voltage to better understand how diodes and shunts (jumpers) work together in a connector assembly that has two power sources sharing conductors in the same circuit.

Thus, implementing a "Y"-connector configuration by the way conductors are attached to selected contacts at the plug and receptacle, resulting in disrupted and redirected signals, external peripherals—whether the integrated monitoring device and configurable power supply in the above example, or even two (or more) discrete external devices—interact with both a host device and its associated battery for simultaneously transferring power (and/or data) signals through a single connector assembly. Ganging together multiple devices is achievable by congregating a plurality of conductors at a single conductive contact element of the plug and/or receptacle. A shared ground is obvious, but a shared positive-signal conductor is practical if one branch of the "Y"-connector is controlled as to its direction of signal flow. Also, ganging devices on a single conductive segment works well for monitoring-type operations.

Four Variables

Various embodiments of a connector assembly of the present invention are configured differently, based on four generic variables. The first variable is the desired specific function/operation of any external devices. Intended external devices, and their uses, determine the configuration and wiring of a connector assembly. For example, if there are two external devices, the first functioning as a battery charger, and the second as a power supply, the routing of power signals through the plug and receptacle elements is specific to charging a battery, and powering a host device. If the external battery-charging device is to operate independently of the power supply, then a connector assembly should be used which has at least four electrical segments and conductors. If a battery charging function, and providing power to a host device function, are to be performed simultaneously, then a four-segmented connector assembly that has a "Y"-connector capability is called for.

A four-conductor cord for attaching one or more external devices, in conjunction with a four-segment plug, provides two independent operations simultaneously. In some interconnect combinations, such as external monitoring of a battery while simultaneously delivering power to a host device from an external power supply, sharing conductors extends the number of external peripherals that can be attached. By the use of insulators to create more conductive segments, in combination with appropriately configured "jumpered" plugs that restore original circuits at the receptacle when no external peripherals are attached, a multi-segmented pin-style connector assembly can be designed that performs a multiplicity of diverse operations. As has already been described, the plug 102A and the receptacle 189 (FIGS. 2A and B) deliver power from an external power supply to a host device, while enabling a battery to still be engaged to its host device should the external power supply shut down, and the connector also disables battery charging. Then, simply inserting a jumpered plug (not shown) into receptacle 189 restores the original circuit between the battery and its associated host device.

The functions/operations a connector assembly of the invention performs are not necessarily the receiving or sending of an electrical signal. A disruption of an electrical path is a function, so eliminating battery charging is considered a valid function. The use of insulators, "Y"-connector branching and redirecting of electrical paths, and various means of making electrical signals flow only in one direction (e.g., diodes, switches, etc.), all combine to optimize the functional and operational capabilities of a connector assembly of the invention.

An example of an application for a means of controlling signal direction flow to eliminate battery charging would be in an aviation environment. The risks of charging high-density batteries that have historically been proven to flame or explode are well known in the aviation community. By including an N-signal switch or a diode 178 (FIG. 7), no battery charging occurs. Airlines would distribute such plug 101H, preferably with an attached power cord specific to airline use. Passengers having a non-switch-enabled plug 101H (which charges batteries) would not be able to use their plug on a plane, as only the aircraft version would attach to a specially-configured receptacle unique to aircraft operations.

Second Variable

The second variable relates to the number of segments on a plug (and on its corresponding receptacle). One of the differentiators between a connector assembly of the invention and other connector apparatuses is an ability to create new circuits with a minimum of connector contacts.

Expanding the operational capabilities of a plug is easily achieved by any/all of the following:

- Design-in more insulators. Placing more insulator rings 179A, B, C, and D along the length of the pin creates more conductive segments.
- Extend the width of an insulator ring to disrupt opposing conductive sleeves at the receptacle.
- Convert conductive plug pin segments to insulators. Certain functions/operations are easier to achieve if an insulator disrupts an existing circuit. For example, a battery charging peripheral attaches to the connector assembly so as to introduce an insulator along the conductive path leading to the host device, thus effectively isolating the battery for purposes of charging. Note: a similar result is achieved by configuring the conductors of the plug to not attach to every available segment.
- Using one or more plug pin segments as conductor-less jumpers to re-attach previously electrically uncoupled devices, sources, or peripherals at the receptacle.
- Gang multiple device conductors at a single conductive pin segment. A shared ground is obvious, but a shared positive-signal conductor is practical if one branch of the "Y"-connector is controlled as to its direction of signal flow. Also, ganging devices on a single conductive segment works well for monitoring-type operations.

For example, an external monitoring peripheral is attached into an existing circuit between a "smart" battery and its data-enabled host device, in order to monitor data signals being bi-directionally transferred between the battery and its host device. In concept, this interconnecting configuration is diagrammatically more a "T"-connector than a "Y"-connector. For clarification, herein a "T"-connector does not usually disrupt an existing electrical circuit, while a "Y"-connector typically disrupts, redirects, and/or creates new electrical paths.

All of the above methodologies apply to both the plug and receptacle. Designers and manufacturers of such segmented connector assemblies should pay particular attention to a properly designed receptacle that can accommodate multiple diversely-configured plugs, each plug configured to provide specific functions/operations.

The connector assembly can function with at least one conductor, that single contact being a jumper. Reconnecting discrete paths with jumpers or terminator plugs compares to the use of diodes, but jumpers have the advantage of allowing bi-directional electrical signal flow along a circuit, whereas a diode can only establish a one-way path.

Depending on the function to be achieved, the connector assembly can function with no conductive contact elements at all. For example, the obverse of a jumper plug is comprised of at least one attachable segment that is non-conductive. Unlike the previous discussion regarding one or more non-conductive segments in a plug configuration, with the jumper plug there are no external conductors whatsoever for attaching peripherals, etc. By incorporating one or more insulator surfaces on a plug, an anticipated function/operation is disabled when the plug is inserted. For example, if the anticipated task is to disable battery charging, then inserting a plug that is configured with an insulator that disrupts the existing electrical circuit between a host device and its battery easily achieves that result.

The role of insulators plays an important part of the operation of a connector assembly of the invention. Where such insulators are placed, and the number of them, is not limited to the examples shown in the figures, and in the text of this document.

Plugs with insulated segments, whether the plug be functional for attaching external peripherals, or a simple conductor-less jumper plug that disrupts one or more receptacle-based circuits, serve discrete purposes in enhancing the operational capabilities of the subject connector assembly. These configuration capabilities aptly illustrate the flexibility such a pin-style, multi-segmented connector assembly presents to designers and manufacturers.

Third Variable

The third variable that determines the configuration of an interface apparatus and its related wiring, use of diodes, insulators, segments, etc., is the number of contacts in a preexisting battery-to-host circuit. Simple two-contact battery packs (see FIG. 2B) or battery holders are easily addressed. But, even non-data-enabled battery packs have more than two discrete connector contacts, with additional contacts dedicated to charging, voltage splitting, sensing, etc. "Smart" battery pack connector I/O ports typically have three data and two power contacts, but only four contacts usually need to be accessed.

A multi-segmented plug, such as that shown in FIGS. 1 and 2A, support both power and/or data functions. The use of insulators in mixed-signal operations applies to disrupting data conductors, as well as power. For example, disrupting the Clock (C), or Data (D) line may be just as effective a means of temporarily disabling battery charging as is causing a power signal along a conductor to be disrupted.

Typically, a convenient way to minimize the number of contacts/conductors in a connector assembly is to incorporate a means of controlling the direction of signal flow, primarily diodes and switches.

Another advantage of using switches and diodes is that multiple external peripherals can co-exist in the same circuit created by the connector assembly. An N-signal switch, which is activated by the presence of an electrical signal at the input side of the switch, provides a means of accessing an external monitoring peripheral. An N-signal switch helps selectively interconnect an external peripheral to a battery and/or a host device. It is desirable to have a battery-monitoring peripheral accessible to more than one other peripheral in the circuit, because so many operations rely heavily on acquiring battery information.

For example, by using an N-signal switch, both an external power supply and an external battery charger peripheral access the monitoring peripheral in order to acquire battery (or host device) information. The power supply accesses battery power-output information available at the monitoring device, in order to configure its output signal to the host device. On the other hand, the battery charger accesses the same monitoring peripheral for battery-charging information in order to deliver an appropriate charging signal to the battery.

FIGS. 2A and B illustrate a modality of the connector of the present invention that uses four conductors to monitor a battery while simultaneously delivering power to a host device. The same functionality can be achieved by incorporating an N-signal switch that responds to the application of power by switching its pair of power pins. A switch so configured establishes a junction between a battery and a host device, so that a "Y"-connection is created. This switch responds to the power signal from a battery along one branch of the "Y"-connector, so that it closes a circuit between an external power source and a host device. The presence of a battery in the circuit automatically triggers the flow of power between an external power device and a host device. Should the battery be removed, loss of power to the N-signal switch causes it to go open between the external power source and the host device. This adds an additional layer of safety to the connector apparatus (see the section "Cables and Muxes" herein for more on N-signal switches).

Fourth Variable

The fourth variable is the determination as to where to install the receptacle. Locating a connector element in a battery pack affords a simple upgrade for existing host devices, by simply removing the present battery pack, and replacing it with one that has been upgraded with a receptacle of the connector assembly. This is the preferred modality but, if battery mounting is not feasible, any of the embodiments of the connector assembly herein can be relocated outside a battery housing. A receptacle should be located in a user-accessible area of a host device, of course, if it is to serve as a primary power-input I/O jack.

Where the circuit between a power source (external to, or internal to a host device) and associated devices is changed by interposing a receptacle is not limited to only within a battery housing.

Multi-Segmented Pin-Style Connector

Plug 102 (FIG. 1) exemplifies a multi-segmented pin-style connector, similar in conformation to typical audio connectors. However, the number of segments may differ from the two or three segments normally found on audio connectors, as well as the way these segments are electrically configured. While segmented pin-style connector 102 is not limited by the number of segments, the plug's pin assembly 177 should have a minimum of two segments. In the four-segment configuration shown in FIG. 1, only a two-conductor cable 121 is provided, as would be the case in a connector apparatus that is intended to deliver power from an external device. Attached to terminuses of conductors 123 and 125, can be a multiplicity of peripherals, as depicted in FIG. 1 as elements 150, 152, 154, 156, 158, 160, 162, and 164.

The use of four conductive pin segments 181A–D in FIG. 1 is an equivalent to plug 102A in FIG. 2A, differing only in how the four contact segments are configured electrically to disrupt redirect, or connect power (and/or data) signals at a host device 168, or its battery 187. For example, conductor 123 is attached to pin contact segment 181A, and conductor 125 is attached to pin contact segment 181C. Thus configured, this connector can be for attaching to an external power supply 152 that delivers power to host device 168.

Since pin segments 181B and conductive pin tip 181D are unassigned and available, a companion circuit for another peripheral that has its own plug 102, but which is configured differently, is viable. This alternative plug is configured so that its conductor 123 is attached to pin segment 181B, while conductor 125 is attached to pin segment 181D. So configured, this second interchangeable plug 102 may be attached to an external battery charger 156 that charges battery 187 (FIG. 2B) of host device 168. In an application where a shared ground conductor is practical, a plug 102 can be built with only three segments, one of which is a shared ground.

Or, given a shared conductor of a three-conductor cable assembly instead of the two-conductor version 121 (FIG. 1), two discrete peripherals (e.g., a monitoring device 154 and a power supply 152) can be attached simultaneously and operate together using a single shared plug 102.

Using a single third conductor (not shown) for a shared ground line, the signal flow in this configuration of a three-conductor connector assembly starts at the power supply 152 (FIG. 1), where its positive (+) signal travels first along conductor 123 to plug's pin segment 181A. When modified plug 102 is inserted into receptacle 189 (FIG. 2B), pin segment 181A aligns with receptacle's conductive sleeve 182A, which causes the signal to transfer to sleeve 182A, then flow along attached conductor 193 to electromechanically attached battery pack housing contact pad 213. When the battery pack 187 is inserted into the battery bay of its host device 168, contact pad 213 electrically engages to the mating contact at the host device (not shown), thus the positive signal flows from the power supply 152 to the host device 168.

The positive (+) signal for the simultaneously attached monitoring peripheral 154 starts at the battery 187 (FIG. 2B) which this peripheral is about to monitor. From battery terminal 209, the signal flows along conductor 195 to receptacle 189's conductive sleeve 182B which, since modified plug 102 (FIG. 1) is inserted, the signal transfers to pin segment 181B, then along conductor 125 to monitoring peripheral 154.

The third conductor (not shown) as a shared ground line is attached to the negative (–) outputs of both the power supply 152 and monitoring peripheral 154, and the signal flows along this third conductor to plug 102, where the conductor terminates at both pin segments 181C and 181D. The inserted plug aligns, electrically engages, then transfers the ground signal from these two pin segments to receptacle sleeves 182C and 182D, respectively. From sleeve 182C, the signal travels along its conductor 197 to its terminus at contact pad 203, which addresses host device 168 once the battery pack is inserted into its battery bay. The second sleeve that carries the ground signal is 182D, from which the negative signal flows along its conductor 199 to its terminus at battery 211A's negative terminal 207.

The connector assembly, modified with a plug that has three conductors, enables a monitoring peripheral 154 to access signals flowing from battery 187 along the electrical circuits described above, while a power supply 152 which is also attached along with the monitoring peripheral, delivers power to a host device 168. Such configurations point to the flexibility that a simple—yet sophisticated—connector assembly of the present invention has in redirecting a signal that had previously flowed from battery 187 to its host device 168, to now flow along a newly-created electrical path to a battery monitor 154 while, simultaneously, an external power supply delivers power signals to the host device 168.

Note that the simultaneous operations of monitoring a power signal and delivering a power signal via a three-conductor connector assembly is electrically feasible because the external power supply outputs a power signal that is an electrical equivalent to the power signal output by battery 187. Thus, the shared ground conductor is acceptable in these operations.

Four-Conductor Connector Assembly

FIG. 2A illustrates a plug 102A that is configured with a four-conductor cable, which enables a larger variety of attachable peripherals than the previously described two-conductor modality in FIG. 1. Conductors 123A and 125A serve to attach peripherals that are electrically incompatible, such as an external power supply 152 and a battery charger 156. Battery chargers output much higher voltages than power supplies, because charging a battery requires a higher voltage for greater charging efficiency. Also, some rechargeable batteries are best replenished by pulse charging, or other exotic charging operations. Therefore, the use of a shared ground line is not feasible with two such incongruous peripherals.

In disrupting and disengaging the circuit for power flow from a battery pack 187 (FIG. 2B) and its host device 168, the configuration of the connector assembly must not only disengage the existing battery-to-host electrical path, but also create a first new circuit specific to attaching the power supply 152 to the host device 168, as well as a second new circuit specific to attaching the battery charger peripheral 156 to the isolated battery 187.

Tracing the signal paths, the power supply 152's positive (+) polarity signal travels along conductor 123A (FIG. 2A) to plug 102A's pin segment 181A. By inserting plug 102A into receptacle 189 (FIG. 2B), pin segment 181A aligns with and electrically engages receptacle's conductive sleeve 182A, to which the signal then transfers. From sleeve 182A, the positive polarity signal flows along attached conductor 193 to battery pack housing contact pad 213. As previously described, when the battery pack 187 is inserted into the battery bay of its host device 168, contact pad 213 electrically engages to a mating contact at the host device (not shown), thus the positive signal flows from power supply 152 to the host device 168.

The power supply's negative (–) polarity signal first flows along plug conductor 123B to pin segment 181C which, since the plug 102A is mated to receptacle 189, engages pin segment 181C to receptacle's sleeve 182C and, thereby transfers the signal so that it then travels along battery conductor 197 to battery housing contact pad 203, where it is available to host device 168 when the battery pack is inserted into its battery bay.

The battery charger 156 (FIG. 1) has its positive (+) polarity signal first travel along conductor 125A (FIG. 2A) to plug pin segment 181B then, because this pin segment is electrically engaged to sleeve 182B at receptacle 189, the signal transfers and next travels along battery conductor 195 to battery 211B's positive terminal 209. The negative (–) polarity signal travels along conductor 125B to plug's conductive pin tip 181D, then is transferred to receptacle 189's conductive sleeve 182D because the plug is mated to the receptacle. From receptacle sleeve 182D, the negative signal continues along battery conductor 199 to battery cell 211A's negative terminal 207.

Thus configured, connector assembly 210 in FIGS. 2A and 2B provides two discrete circuits along four conductors, each path directed to a different target, i.e., battery and host device, so as to perform distinctively different functions along each of the two circuits. First, the function of disengaging and electrically isolating battery 187 from its host device 168. The second function achieved is a new circuit which connects an external battery charger peripheral 156 to battery 187. And, the third function performed is another new circuit that connects an external power supply 152 to host device 168.

As discussed in greater detail in the section "Cables and Muxes" herein, including an N-signal switch 178 (not shown) along the conductive paths created by conductors 123A and 125A (FIG. 2A), a more sophisticated circuit can be configured which also attaches a battery charge monitoring peripheral. This adds further flexibility to the above-described interactive four-conductor circuit. Thus, with an added automatic switch, a four-conductor connector assembly 210 is capable of supporting three external peripherals and two existing devices . . . a true multiplicity of interconnected devices.

To reestablish the original connections of the circuit that routes signals from battery 187 (FIG. 2B) to host device 168, a jumpered terminator plug (not shown) is used. This plug has the same physical characteristics of plug 102A (FIG. 2B) but, electrically, it has internal jumpers (shunts), the first of which interconnects conductive pin segments 181A with 181B, and the second shunt interconnects pin segments 181C with 181D. This simple apparatus reconnects the two positive (+) polarity conductors 193 and 195, as well as the two negative (–) polarity conductors 197 and 199, thereby allowing power to flow from the battery 187 to host device 168.

Since the connector hardware required to perform all of the above-described interconnections is embedded into a battery pack, there is no loss of space in today's miniaturized mobile computing products.

Two-Conductor Version

Batteries with two contacts are extremely common, ranging from applications in flashlights to power toothbrushes. Included in two-contact batteries are battery holders, or battery clips, that accept individual replaceable battery cells. Real world examples include low-end electronic devices, such as toys, tape recorders, TV remotes, etc. There is also a category of batteries and their associated host devices that have two primary battery contacts, but also include one or more secondary contacts. These secondary contacts, quite prevalent in devices such as battery-powered tools, are usually reserved for proper operation of free-stranding rapid-chargers (as compared to mobile computing devices, which have their charging circuits integrated into the host device). For these simpler devices, a connector assembly with two conductors is often ample.

Another prospective use of the two-conductor variant of the present invention is for attaching external fixed-voltage power supplies. The assumption is that, for example a 9.6-volt battery is common among a group of devices, such as battery-powered drills. Thus, an attachable 9.6-volt power supply would operate a number of such drills. Therefore, the connector assembly being discussed here is for providing this class of tools a common interface, so that when the battery goes dead, a user can still operate the drill by plugging in an external 9.6-volt power supply. Integrating a receptacle such as that shown in FIG. 1B into the battery housing of the drill, so that the external power supply connects directly into the battery has an advantage in battery-powered drills. The drill's battery also serves as a counterbalancing element that prevents the drill from being top heavy and awkward to operate. So, leaving the battery in place while operating the device on external power is actually a hidden benefit.

Two-conductor connector assemblies shouldn't be dismissed as lacking the sophistication and flexibility of the four-conductor modalities. In applications where a shared conductor is feasible, a two conductor connector assembly performs surprisingly well. For example, with the classic triangle of a host device with a two-contact device-to-battery I/O port to which is attached a removable battery, a two-conductor plug 101 and a receptacle 101B are a good choice for interfacing an external peripheral.

FIGS. 2A and B illustrate a plug 102A with a four-conductor cord but, since the description here is of a two-conductor version of the connector assembly, only conductors 123A and 125A will be used in this example. Conductor 123A is attached to plug 102A's conductive pin segment 181A, and conductor 125A is attached to two pin segments 181C and 181D. Pin segment 181B is not used and is inactive electrically.

The wiring schema to integrate the connector construct is simple. A cell 211B of battery pack 187 outputs a positive power signal along conductor 195, which is attached to receptacle sleeve 182B. When mated, conductive pin segment 181B of plug 102A engages receptacle sleeve 182B, thereby transferring the positive battery signal to the plug. A means of controlling the direction of flow of electrical signals is strapped across plug contacts 181B and 181A, so that the signal flow is directed only from the battery to the external peripheral. Plug conductor 123A attaches to pin segment 181A (not 181B) so that the diode is properly in the electrical path between the battery and the peripheral. The peripheral here is a power supply.

Starting at the host device 168 and going back toward the battery, the positive signal starts at contact pad 213, which is accessible to the host device when battery pack 187 is inserted in its battery bay. Conductor 193 is the electrical path between receptacle sleeve 182A and contact pad 213. Note that the battery attaches to receptacle sleeve 182B, but the host device attaches at sleeve 182A. This is to keep the diode in the plug in only the battery branch of the "Y"-connector. By attaching the host side of the circuit upstream of the diode, a clear electrical path between the peripheral and the host device is maintained.

However, in a situation where the peripheral device is not active, battery power still flows from the battery to receptacle sleeve 182B, then to plug's pin segment 181B, through the diode to pin segment 181A, and then to receptacle segment 182A to the host device's circuit. If the power supply turns off, battery power flows to the host device, but through the diode, so there will be a very minor voltage loss in this circuit due to the diode, but that is relatively insignificant. Actually, the voltage drop caused by the diode actually has a minor good effect, as will be seen.

The negative battery signal starts at battery cell 211A and flows along conductor 197 to receptacle sleeve 182C. The negative signal, going backward from the host device at contact pad 203, then travels along conductor 199 to also terminate at receptacle sleeve 182C. Thus, there are two apparatuses attached at the same contact point in the receptacle. Plug's pin segment 181C is electrically engaged at receptacle sleeve 182C, and conductor 125A takes the negative signal to the external power supply.

Operationally, it may at first appear that there is electrical contention, as the battery circuit to the host device is the same circuit to the attached power supply . . . all three devices are tied together on the same two conductors. When the plug is not inserted, the diode across receptacle sleeves 182B and A is not present, so no power from the battery can flow to the host device. But, once the plug is inserted, the diode closes the circuit between the battery and the host device, as well as the circuit between the power supply and the host device (which is what is desired in order to deliver power), but the circuit between the battery and the peripheral power supply is also active, as the battery signals now flow to the power supply.

It would seem that two different power signals, one from the power supply and the other from the battery, cannot coexist in the same circuit. The reality is that only one of the signals will flow along the circuit, and it will be the one with the higher voltage. The principle of Dominant Voltage, as described elsewhere in the document, dictates that the strongest signal along a conductor will suppress the weaker signal and dominate the circuit. Thus, as long as the power supply outputs a voltage above that of the battery, the power supply will be able to deliver power to the host device. Once that higher voltage signal is removed, the battery's power signal will occupy the circuit. Since the diode is in the electrical path from the battery, the voltage suppression caused by the diode actually helps to ensure that the power supply's power signals will control the circuit.

Because the diode is in the plug and not the receptacle, it is removed when the plug is retracted, so that the battery is not continuously-sending its power signals through the diode, even when the power supply part of the circuit is removed. Since the pin-style connector assembly uses a jumpered terminator plug to close the circuits when the plug 102A is removed, the jumpered plug only need to reconnect receptacle sleeves 182A and 182B to restore the original circuit between the battery and its host device.

To read more about how this arrangement of the two-conductor plug operates, refer to the section titled "Theory of Operation."

Interchangeable and Replaceable

By making plug 102A (FIG. 2A) and its cable interchangeable, variants of such plugs will have different conductor configurations to accommodate various applications. A common receptacle, configured to a standard so that any designer or manufacturer of interchangeable plugs can be assured of proper fit and function, will resolve longstanding connector conformity issues.

Interchangeability is important, since host device designers historically have used a distinctly different connector assembly for every electrical or electronic product, even to changing to a different connector apparatus for each model of these products. The reason for such behavior is understandable. A vendor's laptop model #1 operates at 9.6 VDC, model #2 requires a 12-Volt DC input power signal, while model #3 uses 18 VDC . . . and all three of these models may be offered simultaneously in the marketplace! In order to avoid voltage mismatches from look-alike AC/DC power-conversion adapters, the manufacturer installs a different receptacle at the device, and builds the adapter with a plug that only fits that receptacle, so that a user cannot (theoretically) attach a mismatched power source to any of the devices.

That concept was sound, until the entire universe of available connector assembly variants (approximately 50), had been consumed by the first 50 models of the device. At that juncture, a new and previously unused connector was not used on the 51st model of the device. Instead, the vendors simply went back into the pool of already in-use connector assemblies, thus causing the very problem of incompatible devices and power-conversion adapters that the vendors were originally trying to avoid. Today, there are over 300 laptop variants, which mathematically means that there are likely five AC/DC adapters that will mechanically connect to a given host device, but which output an incompatible power signal.

Interchangeable plugs 102A in FIG. 2A provide a simple, reliable, and low-cost solution to this adapter-to-device incompatibility dilemma. The flexibility in configuring a receptacle and matching plug of the pin-style connector assembly enables vendors to individualized connector solutions. Which contact points conductors attach to, integration of various means of directing signal flow, number of conductors used to achieve a specific application, insulating certain contacts by not attaching a conductor (or, in the obverse, attaching multiple conductors to a single shared contact), jumpering contacts, individualizing a jumpered plug, etc., all contribute to enabling a vendor to continue the "one-device-per-distinctive-connector" paradigm. But, by continuing that paradigm, the issue of available plug variants is controlled by an interchangeable plug 102A.

The combination of a pin-style connector assembly and a configurable power supply should serve to bring a more rational approach to the connector-selection behavior of device designers and manufacturers. Replacing the ever-growing legion of distinct AC/DC power-conversion adapters is at the root of solving the problem. An external configurable power supply 152 (FIG. 1) that can automatically output any power signal across a wide range of voltages is pivotal. The universal, "plug 'n play" power adapter configured with an onboard A/D converter (and/or "smart"-battery-compliant communications capabilities), a processor and appropriate program instructions—first queries any previously unknown host device's battery to determine the power requirement of the device. Then, after configuring a power supply 152's power output signal, delivers a battery-compatible power signal to the host device at the device's battery I/O port.

A power supply 152, thus configured and in conjunction with the pin-style connector assembly herein, anticipates potential plug-receptacle electrical mismatches. A receptacle that is mechanically compatible (i.e., the mechanical fit is proper when mated to a plug 102A), has to be properly wired so that an external power supply 152 can access a battery. Since the first state of the power supply is to poll a battery in order to determine the power supply's output, only receptacle and plug configurations that causes battery signals to flow to the power supply will result in the power supply proceeding to its second state of power configuration. Since the receptacle just connected to inherently must be configured to enable signal flow between the battery and its host when a plug 102A is not engaged, then it is assumptive that if the battery signal flows to the external power supply, that a signal sent from the power supply back to the receptacle will correctly flow to the host device.

By implementing this one-size-fits-all power adapter solution, the underlying adapter incompatibility issue will inherently lead to the host device industries discontinuing their already-failed distinct connector paradigm. In the meantime, the interchangeable plug 102A provides an interim and transitional solution, whereby a user can simply switch a plug subassembly to match a device's receptacle.

Design Considerations

In designing and fabricating plug and mating receptacle contacts, the current-carrying capability of the conductive materials should be sufficient to handle the power required by a host device. With laptop computers, for example, 50-Watts is not uncommon. The "ampacity" rating (at temperature) of contacts, conductors, etc., should be optimized to not cause any power loss. So, too, will there be variations in plug-retaining mechanisms, spring contacts, attachment points for conductors, insertion/retraction staging, number and location of insulators, shape and dimensions of a plug's backshell, as well as plug and receptacle contact sizes and arrangement along the pin assembly.

It is preferred that contact sizes be enlarged longitudinally along the pin, since the length of the pin assembly is less an issue than its diameter when mounting the receptacle in a valley between two adjacent cylindrical battery cells. Do not overly grow the overall length of the receptacle assembly 189, as the length of the plug's pin assembly 127 (FIGS. 2A and B) will extend as well. An excessively long plug pin is not only more prone to physical abuse and damage but, it also can become a lever that can damage the receptacle if an excessive side load is placed on the plug's backshell.

The confined space limitations inside a typical battery pack might well pose potential barriers to using large-surface-area electrical contacts, or the use of heavy-gauge conductors. Space-saving flat metal zinc (or nickel-plated zinc) strip conductors is advantageous in routing receptacle powerlines inside a battery enclosure (see conductors 193, 195, 197 and 199 in FIG. 2B).

If a receptacle is to be integrated into a new battery pack at the design stage, then wiring troughs and space for a receptacle can be pre-planned. Since receptacles are integrated as retrofits to existing battery packs, the emphasis on selection of conductive materials is an important consideration. For retrofitting existing battery packs which cannot grow dimensionally, remolding the pack's plastic housing to allow for installing a receptacle and creating wiring troughs is a valid approach, but only if production quantities justify the additional cost.

With existing battery packs, additional space inside a pack's housing can sometimes be created by removing older, lower-capacity battery cells, and replacing these with newer, smaller (and perhaps even higher energy-density) ones. Li-Ion cells manufactured in 1996, for example, were twice as big, and almost half as energy-dense as ones manufactured in 1998.

Polymer Li-Ion cells, with their rectangular shape and variable form factors, can also replace existing cylindrical cells in existing battery enclosures. Rectangular cells yield more energy-density per square inch. The unused space left as "valleys" between adjacent columns of cylindrical cells can be eliminated by using rectangular polymer cells, thus freeing considerable room (as much as 20% of an existing battery pack's volume) for a receptacle.

For cylindrical cells, older "sub-C"-sized cells and 18 mm cells can be replaced with 17 mm cells, or even 15 mm cells, usually without any trade-offs (and perhaps even improvements) in total pack capacity. Substituting smaller cells creates room for a receptacle and the related wiring, without having to modify the battery pack's plastic enclosure.

Furthermore, all connector assemblies discussed in this document and shown in the various Figures, and any variants or alternative embodiments, can be installed either in a host device as a primary (or secondary) power-input port connector, or in a battery pack 187.

Those skilled in the art of connector design and fabrication will be able to fit any of the examples of the receptacle of the invention into an existing battery pack.

A connector assembly comprising a plug 102 (FIG. 1) or 102A (FIG. 2A) and a receptacle 189 (FIG. 2B) lends itself to the space limitations of a battery pack. Receptacle 189 looks large as drawn, but it will fit comfortably in most battery housings. The contoured shape of the receptacle shell 190 is designed to fit the curvature of the battery cells, and the curvature of the shell can be adjusted to fit various diameter battery cells.

How a battery pack inserts into its bay (cavity) in a host device is a noteworthy consideration when designing this multi-contact connector assembly for battery pack installation. Most battery packs insert end-wise into a battery bay, leaving the face at one end of the pack housing exposed. A receptacle 189 (FIG. 2B) is accessible through an opening along this exposed face of the battery housing. Packs with cylindrical cells typically have their cells stacked end-to-end in columns. A convenient "V" (in the end-view of two adjacent columns of cells) between cell columns is available as a valley for installing a receptacle and related conductors.

The open end of the receptacle is situated directly behind the pack's housing wall, and an opening in the wall provides access for the plug. Exact location of the receptacle should always be driven by user access to the receptacle for plug insertion, as well as a location that does not cause a plugs cable to interfere with user operation of the host device.

With a battery pack thus configured, a user can interconnect a variety of external peripherals through this interface. Depending on the wiring schema of the connector assembly, any external peripheral can transfer electrical signals either with a host device 168, or its battery 187—even multiple peripherals can concurrently (or simultaneously) access either/both the host and/or its battery.

Occasionally, the orientation of the cell columns in a pack are at 90-degrees to the exposed face of the inserted battery pack housing, making the valley between columns unavailable for receptacle installation. In such situations with existing battery packs, designers should consider replacing the cylindrical cells with smaller ones. As previously discussed, smaller cells may actually have more capacity than those being replaced. Another option is to replace the existing cylindrical cells with polymer ones. This approach will almost certainly bring more pack capacity, while freeing ample room for the connector receptacle. Also, Li-Ion cells are rated at higher voltages (about double the voltage of a Ni-Cad), which means that fewer total cells are required.

Any dimensional considerations or proportions indicated or suggested by any of the figures presented herein should only be interpreted as suggested relative sizes of parts or subassemblies. Actual size, shape, and proportions may differ depending on specific applications and implementations.

Cables and Muxes

For battery packs that install by first inserting their larger top or bottom surfaces into a battery cavity (instead of sliding an edge face of the pack end-first into a battery bay), the issue of cabling is important. If the battery cavity is located on the bottom face of a host device, such as the underside of a laptop computer, then a round cable exiting from the battery bay beneath the host device is not acceptable. The cable thickness could cause the host device to not sit flush on a flat surface. Since there may not be enough clearance under a host device to route a round cable, then a ribbon cable, or a flat cable built using flexible circuit board techniques, provide the low-profile required in such tight confines. Standard ribbon data cables work fine for power delivery by tying together several of the 28-gauge conductors to provide sufficient conductivity to eliminate voltage drop or temperature rise.

As for muxes, FIG. 2A illustrates a modality of a plug of the connector assembly of the present invention that uses a four-conductor cable for both monitoring a battery and simultaneously delivering power to a host device. The same functionality can be achieved with fewer than four conductors by incorporating an N-signal switch in the circuit. The N-signal switch operates by switching a pair of power pins on the switch in response to the application of power to the switch.

A switch so configured establishes an attached peripheral with a junction between a battery and a host device, so that a three-branched "Y"-connection is created. For purposes of this non-limiting example, the switch is at the juncture of the three branches of the "Y." A battery is at the terminus of the first branch of the "Y"-connection, the host device is at the terminus of the second branch, and a user-selectable peripheral is attached electrically at the terminus of the third branch. In this example, the attached peripheral is a multi-function device that is capable of both receiving electrical signals for monitoring battery power output, and the peripheral also has a variable-output power supply incorporated that is capable of outputting a power signal for powering the host device.

In operation, the switch is configured by receiving a power signal from the battery along the first branch of the "Y"-connector. The switch is configured to both direct the battery's power signal to the host device along the second branch, and also to direct the same power signal to the peripheral along the third branch. Here, the peripheral is in a battery monitoring mode, which enables the peripheral to capture information as to the battery's output voltage.

Further, once the peripheral has captured battery Vout information, the variable output of the power supply is then configured to a voltage value compatible with the voltage range of the battery. When received at the switch, the power signal from the power supply along the third branch causes the switch to reconfigure the circuit to direct this power signal (instead of the battery's) to the host device along the second branch.

In this configuration of the peripheral delivering power to the host device, the need for a battery in the circuit is not essential, and the battery can actually be removed. But leaving the battery attached adds an additional layer of safety to the operation of the connector assembly because, should the power delivery from the power supply peripheral along the third branch be disrupted, the N-signal switch immediately re-establishes the previous configuration, with the battery as the source of power to the host device along the first and second branches—thus providing battery backup capability.

For low-voltage (and/or data) signal switching, for example, a Maxim (Sunnyvale, Calif.) MAX 4518 is a type of multiplexer (N-signal switch) for use in a connector assembly circuit to eliminate conductors. Modifying the MAX 4518 so that it is driven by the simple application of a power signal only requires jumpers from pin 2 (EN) to pin 14 (V+), and a second jumper across pin 4 (NO1) and pin 15 (GND). Thus configured, a single power supply voltage (here from the battery and/or from an external peripheral as a power source) will trigger all four of this analog mux's channels. The 4518 will operate with up to a 15 VDC maximum input. This voltage is within the range of some battery pack output voltages. For higher voltages, power FETs are used. The MAX 4518 can be over-voltage protected with external blocking diodes (consult the Maxim data sheet #19-1070). An upstream voltage regulator, preferably one with a wide range of input voltages, can be used with the MAX 4518.

Embedded in a Battery Pack or Peripheral

A multiplicity of connector elements can be integrated into an individual embodiment of the present connector assembly, such as insulators, insulator rings, jumpered plugs, segmented contacts, etc., for configuring specific implementations and applications. The connector assembly provides an effective upgrade to a host device and its associated battery pack to operate with a multiplicity of external peripherals. This interface adds functionality that was neither originally designed into a host device, nor its battery. The external peripherals may, or may not, have been originally designed by the host-device vendor specifically for a particular host device. These peripherals typically include an external power supply, battery charger, and a battery monitoring device. These may be separate single-function peripherals, or all three functions may be integrated into one attachable unit, with each sub-system capable of functioning autonomously. One of the primary objectives of the present invention is to provide users with configurable peripherals that automatically configure when connected to a wide range of unknown host devices.

FIG. 2A illustrates a plug 102A that is configured with a four-conductor cable. A first pair of conductors 123A and B, for example, attaches to an external power supply peripheral 152 which is configurable to deliver a controllable output voltage to a host device 168 (FIG. 2B). Rechargeable battery 187 is the original power source for the host device.

In order to determine the correct voltage to which to configure the output of the power supply, a second pair of conductors 125A and B (FIG. 2A) is used. This second pair of conductors is configured in plug 102A and its mating receptacle 189 (FIG. 2B), so that the output voltage of battery 187 is readable along these conductors. Conductors 125A and B serve as voltage "sense" lines that transfer a power signal from the battery to an attached battery monitoring peripheral 154 (FIG. 1). This peripheral "awakens" when battery power is received, then acquires the incoming battery signal at an A/D converter 158.

Once the battery voltage is acquired, a processor circuit 160 in FIG. 1 (or 172 in FIG. 2B) and program instructions 162 in FIG. 1 (or 170 in FIG. 2B) compute power supply 152's variable output to a voltage value within the now known range of battery 187's output. This voltage signal is then output from the power supply to the host device 168 (FIG. 2B) via the first pair of conductors 123A and B. This example of a four-conductor interface apparatus enables an external controllable power supply to deliver a correct battery-based voltage to a host device, while also temporarily disengaging the battery from the host device's original battery-to-host circuit.

Where practical, embedding the sensing function in a host device 168 (FIG. 2B) does have the benefit of potential access to an existing A/D converter 174, processor 172, and perhaps even already-resident resources for embedding sensing software 170. Even though the host device might have a suitable processor and other voltage-sensing hardware and software, it is usually impractical to modify an existing host device. The voltage sensing and processing circuit, in this modality of the invention, is embedded—typically, in an external peripheral such as the battery monitoring unit 154 (FIG. 1), or the configurable power supply 152, itself A host device's battery pack, especially if it is a removable module, is an acceptable location for an embedded A/D converter 174, processor 172, and resident program instructions 170 as in FIG. 2B. This is an especially valid approach with "smart" batteries, which often have onboard processors and A/D converters. Should a "smart" battery be the site for the embedded sensing circuit, then the signal transferred along conductors 125A and B is for acquiring digital data signals. Digital data acquisition usually requires at least a third conductor, so one of the available power conductors 123A or B is then used.

Further details of the sensing circuit are not discussed here, because such circuits are commonly known and readily available to those skilled in the art.

By incorporating an N-signal switch as a means of controlling signal flow direction 178 (FIG. 2A) in a circuit that includes conductors 125A and B, the previously referenced battery-voltage sensing circuit is combined with suitable program instructions (software) 162 in FIG. 1 (or 170 in FIG. 2B) to configure an external battery charging peripheral 156 to deliver an appropriate charging signal to a battery 187 (FIG. 2B). This adds further flexibility to this interactive circuit.

The battery charger peripheral 156 replaces the external power supply 152 in FIG. 1 at conductors 123A and B in FIG. 2A Or, the sense-line conductors 125A and B branch at an N-signal switch 178 (FIG. 2A), so that in a first switch position the signal from the battery 187 (FIG. 2B) travels the along a first branch comprised of conductors 123A and B to the battery monitoring peripheral 154. Just as the battery monitoring peripheral configured the output of the power supply 152, it also configures the charging profile of the battery charger 156. The charger delivers its charging signals to battery 187 (FIG. 2B) along conductors 123A and B.

Once the switch is in its second position, conductors 125A and B (FIG. 2A) as the second branch in the circuit, are available to the power supply 152 for delivering power to host device 168 (FIG. 2B). This configuration with a voltage-sensing circuit shared by both an external power supply 152 and a battery charger 156, enables sequential powering of a host device 168 and also recharging a battery 187.

Battery Monitor

Battery monitor 154 (FIG. 1) is characterized as a device (or circuit within another device) that performs an information-acquisition function, namely acquiring voltage readings from a battery 187 (FIG. 2B). An A/D converter 158 in FIG. 1 (or 174 in FIG. 2B) and a simple processor are the key elements required for this peripheral to function. The processor has an I/O which interfaces with configurable power supply 152. A battery monitor 154 uses this I/O to communicate battery 187's voltage (read both without a load, then with a resistance in the line) to configurable power supply 152.

A Hall-effect device, or other methods of reading current known to those skilled in the art, can be used to acquire battery 187's current-delivery parameters, but these values may not be necessary to the proper operation of the external peripheral.

Battery monitor 154 (FIG. 1) uses both a load and no-load sampling of battery 187's output voltage to ascertain whether the battery is in a relative state of full-charge, or almost completely discharged. Should the battery be fully charged, its no-load output voltage will be substantially higher than its manufactured "design" voltage.

For example, a battery pack manufactured as "12 VDC" may read nearly 14-volts output under a no-load condition, even though it has less than 40% remaining capacity, but that output voltage may drop to less than 10.5-volts when tested under load.

A fully charged battery will not likely read less than 12-volts output when sampled under the same load. Since battery output may cover a range of voltages, depending on the load vs. no-load sampling results, program instruction at battery monitor 154 in FIG. 1 (alternatively 170 at battery 187 or host 168 in FIG. 2B) uses a look-up table and an algorithm to determine what the manufacturer's "design" voltage is for battery 187.

Software attempts to accurately define an optimized operating input voltage for host device 168 in FIG. 2B. Depending on its battery input-voltage design parameters, host device 168 can have a Vmin operating voltage well below the 12-volt rating of its battery 187. If the designer of the host device was striving for maximum battery-operating time, the Vmin battery voltage may be set low, to use every last coulomb of battery 187's capacity. With a 12-volt Ni-Cad battery, this Vmin voltage cut off can be set as low as approximately 8 VDC. The spread between a battery 187's no-load and load voltage-test results is a reasonable indicator of the remaining "fuel" reserves in the battery. If both Vmin and Vmax are depressed, then it's highly probable that the battery is near exhaustion.

Another indicator is how long it takes for a battery 187 to recover from a load test. All commonly used battery chemistries exhibit an accelerated voltage drop-off curve near the lower limits of their capacity, although the slope (or rate) of voltage drop may vary. So, reading under-load samples over time, or for a sustained amount of continuous time, are also somewhat valid probative procedures for evaluating the remaining capacity in the battery pack. Establishing a reasonable basis of remaining capacity is important to the operation of the connector assembly, since the battery is expected to be relied on as a source of backup power.

Of course, if battery 187 (FIG. 2B) is a "smart" battery, and if there are data lines available at the connector assembly, battery monitor 154 simply polls the battery's data registers for information about its design voltage and fuel gauge reading. However, even "smart" battery technology, with its sophisticated fuel gauges, is not very accurate when it comes to determining the amount of energy reserves remaining in a battery. Error rates are sometimes 10–20%. Knowing this, host device manufacturers tend to allow an adequate margin of capacity in a battery at the prescribed Vmin battery shut-down voltage.

The relevance of knowing the approximate capacity reserves of a battery 187 (FIG. 2B) is related to connector assembly 210. If the battery is about to reach a state of near depletion, then battery monitor 154 is limited in the acquisition functions it can perform. For example, continued voltage sampling under load will produce variable results.

Should there be a lack of readable battery voltage at battery monitor 154, the operation of the battery monitor is to shut down power supply 152. In the situation where a battery 187 is incapable of sustaining a minimum voltage under load, battery monitor 154 delivers a shut-down command to power supply 152.

The processor 160 in FIG. 1 (or 172 of host 168 in FIG. 2B) that controls the configurable power supply, operates on information about the battery. Specifically, based on acquired battery voltage information, the proper calculated input voltage of the host device is sent to power supply as a Vref value. Being a controllable switching power supply, it can output whatever Vref voltage is required. Power supply 152 is also capable of matching Vref as a function of its voltage-sense feedback loop (not shown). Specific information about the operation and characteristics of such a power supply is available in my U.S. Pat. No. 6,459,175, "Universal Power Supply" (1 Oct. 2002).

Battery Charger

A battery charging module 156 (FIG. 1) is also available either as a stand-alone unit, or integrated into an external peripheral 150. The role of battery monitor 154 in conjunction with a battery charger, is similar to that already described for a battery monitor and a power supply 152. The battery monitor gathers data about a battery 187 (FIG. 2B). Once the presence of a battery—and the appropriate user-selected plug configuration for charger connectivity—are verified, battery monitor 154 determines the appropriate charge type and charger peripheral output configuration. Charge type is based on battery chemistry.

Other tests are performed by battery monitor 154 to verify not only the type of battery, but the condition of the battery to accept a charge. This procedure may include a sophisticated impedance test, and perhaps even some cell balancing for Li-Ion batteries. These operations are essential because Ni-Cad charge characteristics, voltages and charge rates vary considerably from the method used to charge Li-Ion cells. Information about impedance testing is available from Cadex Electronics Inc. (Burnaby, BC, Canada).

It is possible to have both a battery charger 156 (FIG. 1) and a configurable power supply 152 integrated in a multipurpose external assembly. In such a modality, battery 187 (FIG. 2B) can be charged simultaneously with power delivery to host device 168, if the connector assembly is so configured. This embodiment reflects the same functions normally available to a battery and its host device when a plug 102A is removed and a jumpered plug reinstates the original battery-to-host circuits. In other words, when the primary circuit between host device 168 and battery 187, as they were configured when manufactured, is re-established.

With battery-information acquisition capabilities provided by a battery monitor 154 (FIG. 1), a battery 187's (FIG. 2B) power parameters are acquired. The configuration of a connector assembly 210 makes it possible to confirm that a battery is present and available. Furthermore, the battery is also known to not be receiving a charge, because the connector configuration redirects the battery-to-host device circuit to engage the battery terminals to instead be connected to external monitoring device 154, and not to an external charger 156. As long as battery monitoring device 154 is occupying battery 187, there can be no battery charging activity. By constantly polling the battery, the battery monitor device keeps track of the battery's non-charging state.

Further, the connector apparatus is configured to create an electromechanical redirection of battery 187's circuit. There is no path for host device 168's internal charger circuit (not shown) to access its battery 187, while the plug 101A is inserted. (See discussions in the section "Cables and Muxes" about using diodes in circuits to enable a battery to deliver power to its associated host device even while a connector assembly is in use.)

Having confirmed that battery pack 187 (FIG. 2B) is in a non-chargeable state, external power supply 152 (FIG. 1) safely applies power to host device 168. Battery monitor 154 has communicated its acquired battery-power parameters to the configurable power supply, so that the power supply can adjust its variable output signal based on the now-known output of battery 187. Since the battery is associated with (and power-matched to) its host device, a correct input voltage to the host device is assured by basing the output of the external power supply on the acquired power parameters of its battery. Battery monitoring device 154 has a processor 160 for configuring the controllable power output of a power supply 152, or the power supply itself may have the requisite processor, software, and even and A/D converter, thus operating as a self-contained data acquisition and power delivery peripheral.

Referencing my U.S. Pat. No. 6,459,175, "Universal Power Supply" (1 Oct. 2002) and my U.S. Pat. No. 6,634,896, "Method and Apparatus for Transferring Electrical Signals Among Electrical Devices" (21 Oct. 2003), an external processor-enabled peripheral is capable of determining whether or not the connector assembly configuration is appropriate for performing the operations of the attached peripherals. For example, if a combined power supply 152 (FIG. 1) and a battery charger 156 are attached, the program instructions 162 of processor 160 and an A/D converter 158 use basic voltage and current sensing methodologies to verify that the anticipated circuits at the connector assembly 210 (FIGS. 2A and B) are correctly configured. If an incorrect connector configuration is detected, neither the charger nor power supply will operate. If data lines are available, they are to pre-confirm the proper configuration, functioning, and operation of the connector assembly.

Interrupted Data Lines and "Virtual" Data Lines

To disable battery charging, for example, any of the connectors shown (but not limited to those shown or equivalents) can effectively interrupt and reroute a data line. In a "smart" battery circuit, for example, rerouting a Clock (C), or Data (D) line will disrupt the circuit of a host device's charging circuit, battery selector, or keyboard controller—the disruption of any one of which is sufficient to prevent battery charging. A battery cannot effectively communicate its request to be charged if Clock or Data lines are not available. The data lines communicate in conjunction with the negative (−) polarity power signal in the SMBus Smart Battery Bus topology, so intervening a connector assembly of the invention on a powerline will have an impact on battery data communications.

But data transfer is not always limited to the use of cables and connectors. Wireless data is available in the form of radio frequency (RF) or infrared (Ir). This is relevant, in this example, to the elimination of conductors between an external third device, such as a battery monitor (or a battery monitor coupled to an external power supply). A "smart" battery data line can be physically interrupted and rerouted using the connector assembly herein.

Most "smart" battery data communications require three or four conductors. "Smart" battery-to-host connector I/O ports typically have five contacts. To disrupt all five lines with a connector assembly 210 in FIGS. 2A and B such as that shown requires 10 conductors, with five conductors from a battery pack to an external device, and an additional five conductors from the external device to a host device. While adding two more contacts to plug 102A isn't impractical, it does create a substantially longer pin assembly 127, as well as a more complex receptacle. The cumbersome cables that would result from routing 10 mixed-signal lines between external devices are not desirable.

In some battery and host data communications implementations, data continuity to a host device may have to be maintained, so that the host can handshake with a compliant battery (or equivalent) present. Without data continuity, the host device may refuse to turn ON, or it may lose track of its battery's "fuel gauge" readings. A wireless link can be established so that, even though the physical data circuit between a battery and its associated host device has been disrupted temporarily, a substitute data telemetry link can be used.

If a power supply 152 (FIG. 1) is fully data enabled, it is capable of querying the host device itself as to power requirements. Typically, the battery serves as Master, and the battery-powered device is the Slave, so the logic of querying the battery directly makes sense. Designers and software developers note that, when a peripheral is attached to a "smart" battery and host device, a processor-enabled peripheral attached by the connector assembly is normally assumed to be the Master, and the host device continues to operate as a Slave. This is important in SMBus, wherein it is the battery that calls for charging and other functions. Thus, a power supply 152 is expected to participate properly with the host device in any acknowledgements, handshaking, host queries, because the power supply replaces the battery when it delivers power, and it is expected to operate as a true battery surrogate.

Alternative Electrical Paths

Alternative data paths can be created. One implementation of an alternative bi-directional data path has a multi-contact connector integrated into a small external module (a PC Card or dongle, for example), through which data lines are routed. The powerlines pass through the module, as well. The purpose of this module is to acquire data from a "smart" battery over standard conductors, but to not have to reroute those conductors to either a host device, or an external device, such as a power supply. The module performs data acquisition functions (especially easy if a National Instrument (Austin, Tex.) DAQ card, or equivalent, is used). Another alternative is to use a dongle configured like a Micro Computer Control (Hopewell, N.J.) SMBus monitor, that converts SMBus "smart" battery data to $I^2C$, or RS-232.

A number of infrared wireless dongles uses a standard RS-232 interface for serial port communications, so those skilled in the art of wireless communications should have no difficulty in creating such a wireless data link.

Computer-readable data is then output to a radio transmitter, or to an infrared port. A comparably-equipped external peripheral, such as a charger or power supply, shares data with the wireless module. Software filters the data stream coming from a host device and/or a "smart" battery, looking for data relevant to battery charging. It may see requests from the "smart" battery, for example, to be charged. An external module would, in that situation, send a wireless signal back to the module, with a message for the "smart" battery advising it that the charger is not available. That "faux" information from the external peripheral is then routed internally in the host device through the connector I/O port that couples the host to its battery, into the battery's data circuit.

Malfunctions, such as spurious data on the "smart" battery bus that is misunderstood as a request to battery charge, are handled by having an external power supply 152 (FIG. 1) (which is attached at the battery connectors in the host device, and not at the host device's power input jack), send "faux" data to a module previously described, which is routed to a host device through a connector assembly 210 (FIGS. 2A and B). Viewed in one way, an external power supply's data intervention into a battery-to-host interface is one of emulating a battery when communicating to a host, and emulating a host when communicating to a battery. The task is, in this example, to prevent battery charging, so one approach is to send appropriate misinformation to a host system, that emulates a malfunctioning battery. Data sent to a battery emulates host messages which indicate that charging functions are not available.

In context of SMBus-based "smart" batteries, the host receives "faux" information from an external power source that the temperature level in a battery exceeds a pre-set alarm level, for example. That will disable the host device's internal charger. A battery can receive alarm or alert states, which indicate a "no-charge-available" condition in the host device.

Another hypothetical scenario that could potentially cause an inappropriate battery charger activation in a host device might be that a plug 102A (FIG. 2A) could be inserted during an ongoing charging activity between a host 168 (FIG. 2B) and its battery 187. This is another highly remote situation, since the insertion of a plug 102A will disrupt all of the power and data lines. It would take an inordinate malfunction for a host device's "smart" battery charging circuit to keep functioning after any one of the four power/ data lines 123A, 123B, 125A, and 125B was disrupted and, for a charger to still be outputting a power signal after all four lines had been disrupted, would be a significant improbability.

The issue of a host device turning on its internal charging circuit while an external peripheral is using those same battery lines to input power to a host device is moot. The probability of this happening is very remote, for two reasons. First, the host device is not drawing power from its AC/DC power-conversion adapter attached to the power input jack but, instead, the host device is drawing power from what it perceives is a battery but is actually an external power supply emulating that battery. There is no acknowledged power source connected to the host device that indicates available power to charge a battery, i.e., there is no AC/DC adapter or wall adapter connected to the power input jack of the host device. This makes any possibility of a host device being able to charge a battery essentially zero.

Second, there is no request for a charge activity from a battery because this battery is temporarily disengaged by the connector assembly 210 (FIGS. 2A and B) disrupting the previous host-to-battery conductors, so a host's charging circuit has no valid reason to turn on the charging circuit. (Many of the alternative approaches discussed here are further detailed in my U.S. Pat. No. 6,459,175, "Universal Power Supply," 1 Oct. 2002, and U.S. Pat. No. 6,634,896, "Method and Apparatus for Transferring Electrical Signals Among Electrical Devices," 21 Oct. 2003.

As previously discussed, in situations where the number of data lines is excessive enough to make wired communications to and from an external device impractical, wireless data communication links serve as alternatives to multi-conductor data lines. The role of a connector assembly is the same . . . to create new data (and perhaps power) connectivity paths that are available at an external device.

SUMMARY AND SCOPE

The benefits of a connector assembly creating new and different electrical paths when a plug is inserted or replaced include the following non-limiting examples:

1) Diminish the need to charge a battery pack when an external power source is available. By not charging a battery every time a host device is connected to an external source of power, the life expectancy of the battery is increased. Since most rechargeable battery-powered electronic devices automatically charge their batteries when external power is connected, the use of a connector that disables the battery charge function increases the useful life of the battery, thus reducing total operating cost.
2) Some locations may not find battery charging practical. Battery charging can consume 20–40% of the entire load schedule of a host device's power requirements. If a car's battery is low, operating a host device such as a laptop that is powered from the dashboard outlet could result in a stranded motorist.
3) Some transportation locations may not be suitable for battery charging. There is some risk in charging batteries, especially high-density Li-Ion batteries. An airline or cruise ship operator, for example, may wish to limit the risk of an onboard battery-related fire or explosion. A simple and cost effective method is to use battery packs and power cords that connect to the subject connector assembly for disabling the charge function, while still allowing an external power supply to power the host device.
4) Extended-run-time external battery packs can be used to supplement a host-device's associated battery. These extra-high-capacity battery packs connect to a host device's existing power input jack. So configured, the external battery pack is dedicating some of its stored energy to charging the host device's battery. This occurs because host systems are designed to charge the associated battery whenever external power is available at the power input jack.

As a power source, a host device usually does not distinguish an external battery from an AC/DC wall adapter, for example, so the extended-run-time battery loses its effectiveness by having to relinquish some amount of its stored energy to charging the host's battery. By using a connector as defined herein, the external battery pack can be routed through the host device's existing battery pack and, by doing so, the charging circuits within the host device are temporarily disabled while the external battery source is in use. This enhances the run-time of the external battery pack, and also eliminates inefficient energy transfers between the two batteries.

These non-limiting examples of applications for connector assemblies such as those described in this document evidence several real-world uses.

Basic Design Parameters

Some of the design parameters achieved by the connector assemblies discussed herein include:

1) Small package size, especially for the receptacle, since available space within battery packs is limited.
2) Straightforward way to integrate a receptacle into an existing battery pack, or to install the receptacle in a new battery pack design in a way that doesn't require an inordinate amount of extra tooling or assembly.
3) Inexpensive
4) Simplicity of use Ramifications A number of advantages of the connector assembly of the present invention become evident:

(a). A simple, low-cost connector can be used to electrically separate two devices, or a host device and its power system.

(b). By isolating the battery source, or a peripheral, from the original host device, new circuits are created that allow external power sources, battery chargers, and other attachable peripherals to perform more safely because the battery voltage can be verified before that external power is applied to a host device.

(c). Because the plug has more than one configuration, additional specialty functions or operations can be performed.

(d). As a replaceable element, a plug 201A in FIG. 2A and its attached cable can be interchangeable, to allow for a variety of plugs that connect a multiplicity of specialty peripherals to a standardized receptacle.

(e). With very small form factors, the receptacle can be embedded inside a battery pack, to make it a self-contained unit that has a special power or data interface to external power or charging devices, or monitoring equipment. This can be accomplished without having to rewire or otherwise modify the host device. By replacing the existing battery pack with one configured with the receptacle, the functionality of both the battery and host device is enhanced, without permanent reconfigurations to either the battery pack or host device.

(f). The receptacle can be used as a replacement for an existing input power jack with minimal modifications or rewiring.

(g). Problems in changing both plugs and receptacles on electronic devices that have incompatible external adapter output voltages are no longer necessary. Instead, the receptacle is simply wired in a different configuration, and a new plug is used to differentiate the two incompatible external adapters. Any fear of possible mismatched voltages between external power adapters and host devices is eliminated.

(h). In certain modalities of the connector that use a "jumpered" terminator plug to reinstate a circuit, the need for an ON/OFF power switch in conjunction with a power input jack is eliminated. The plug is configurable to turn the host device ON when inserted.

(i). The connector assembly has retention mechanisms, such as pin 127's detented tip 183 that secures the plug to the receptacle, an important feature for devices like laptops that are often moved around in industrial or service applications.

(j). In certain environments, host devices that automatically charge their batteries when external power is applied can be easily modified by inserting a battery pack that has the receptacle installed. Thus configured, the host device is rendered compliant in situations where battery charging is not allowed.

(k). Monitoring battery charging can be done by an external device attached to the connector.

(l). Simultaneous battery monitoring and power delivery from an external device can be done without modifying the internal circuitry of the host device.

(m). By installing an N-signal switch that alters electrical circuits in response to applied power signals, and locating that switch in either the plug or receptacle of the connector apparatus, battery monitoring and power delivery can occur with a two-conductor cable that shares more than two contacts in the connector.

SCOPE OF THE INVENTION

Thus, the reader will see that the connector assembly of the invention provides a convenient, low-cost, and when the receptacle is embedded in a battery enclosure, inconspicuous and easily upgradeable connector assembly that not only provides safe power delivery by disabling battery charging, but enhances the overall functionality of any existing (or future) electronic and electrical goods by providing an interface to which a multiplicity of peripherals can be attached.

Although the description above contains many specificities, these should not be construed as limiting the scope of the invention, but as merely providing illustrations of some of the presently preferred embodiments of this invention. Many other variations are possible. For example, the conductive pin segments 181A–D are positioned along pin assembly 127 in a longitudinal placement that causes at least one of the pin segments to straddle an insulator ring at the receptacle 189, so as to jumper two adjacent receptacle sleeves, thereby electrically coupling the two adjacent sleeves to close a circuit. Thus, the scope of the invention should be determined by the appended claims and their legal equivalents, rather than by the embodiments illustrated herein.

Thus, a connector assembly for transferring electrical signals, including power and input/output data among multiple electrical devices and their components, is described in conjunction with one or more specific embodiments. The invention is defined by the claims and their full scope of equivalents.

What is claimed is:

1. A connector assembly for transfer of electrical signals among at least one device and one peripheral device comprising:

a connector plug comprising a conductive pin having one or more conductive segments for transfer of one or more electrical signals;

a connector receptacle attached to at least a device and a peripheral, said receptacle comprising a conductive receiver having one or more conductive segments for mating with said one or more conductive segments of said connector plug; and a processor for adjusting said one or more electrical signals transferred by said connector plug based on control signals received from said connector receptacle;

wherein the mating of said plug and said receptacle, causes a first electrical signal to be transferred to said device and a second electrical signal to be delivered to said peripheral device through the engagement of said one or more conductive segments of said plug and said receptacle as adjusted by said processor.

2. The connector assembly of claim 1, wherein said peripheral device is a chargeable battery, said first electrical signal powers said device, and said second electrical signal recharges said battery based on said control signals.

3. The connector assembly of claim 2, wherein said processor is a voltage sensing device for determining the appropriate voltage to be delivered for recharging the battery.

* * * * *